US006213456B1

(12) United States Patent
Hirano et al.

(10) Patent No.: US 6,213,456 B1
(45) **Date of Patent: *Apr. 10, 2001**

(54) FINISHER FOR USE WITH AN IMAGE FORMING APPARATUS

(75) Inventors: Ryo Hirano, Toyohashi; Kunihiko Kanou, Toyokawa; Tadashi Kobayashi, Toyokawa; Masahiro Nonoyama, Toyokawa; Kazuhiko Nakatsuka, Toyokawa; Shinji Wakamatsu, Toyokawa; Kazuhito Ozawa, Toyokawa, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/002,034

(22) Filed: Dec. 31, 1997

(30) Foreign Application Priority Data

Jan. 8, 1997 (JP) ..... 9-001401
Jan. 13, 1997 (JP) ..... 9-004086

(51) Int. Cl.[7] ..... B42C 19/00; G03G 15/00

(52) U.S. Cl. ..... 270/58.08; 270/58.07; 270/58.11; 412/4; 412/19; 399/408

(58) Field of Search ..... 399/408; 270/52.18, 270/58.08, 58.09, 58.07, 58.11; 412/4, 8, 900, 901, 18, 19; 281/21.1

(56) References Cited

U.S. PATENT DOCUMENTS 4,077,078 * 3/1978 Snellman et al. ..... 281/21 R X
4,473,425 * 9/1984 Baughman et al. ..... 270/58.08 X
4,586,640 * 5/1986 Smith ..... 270/58.08 X
4,611,741 * 9/1986 Wilson ..... 270/58.08 X
4,626,156 * 12/1986 Baughman et al. ..... 412/4 X
4,797,048 * 1/1989 Doery ..... 412/11
4,800,110 * 1/1989 DuCorday ..... 412/6 X
4,989,852 * 2/1991 Gunther, Jr. ..... 270/58.08
5,140,380 * 8/1992 Nakamura et al. ..... 412/37 X
5,213,317 * 5/1993 Mandel et al. ..... 270/58.11
5,240,362 * 8/1993 Nakayama et al. ..... 412/37 X
5,246,328 * 9/1993 Morishige et al. ..... 412/11
5,269,504 * 12/1993 Backman ..... 270/52.23
5,570,985 * 11/1996 Latvakangas et al. ..... 412/4
5,632,587 * 5/1997 Coyette ..... 270/52.18 X
5,832,358 * 11/1998 Sampath et al. ..... 399/410 X
5,881,352 * 3/1999 Kobayashi et al. ..... 399/408
5,931,624 * 8/1999 Naruse ..... 412/84

* cited by examiner

*Primary Examiner*—H. Grant Skaggs
*Assistant Examiner*—Patrick Mackey
(74) *Attorney, Agent, or Firm*—Burns, Doane, Swecker & Mathis, LLP

(57) ABSTRACT

A finisher connected to a copying machine produces a bound booklet by inserting papers from the copying machine into a cover with an adhesive layer of a hot-melt adhesive which is coated on the inner surface of near a spine interconnecting a front board and a back board, and heating the cover and a sheaf of papers, and joining them by adhesion. Thus, the series of operations ranging from the preparation of documents through the bookbinding can be facilitated and expedited.

18 Claims, 21 Drawing Sheets

FINISHER FOR USE WITH AN IMAGE FORMING APPARATUS

BACKGROUND OF THE INVENTION

1. Field of the Invention

This invention relates to a finisher for performing such additional works as sorting, binding, folding, and punching on recording material such as recording papers (hereinafter referred to briefly as "papers") outputted from an image forming apparatus such as a printing machine or copying machine. This invention, more particularly, relates to a finisher having the function of binding which comprises inserting papers from the image forming apparatus into a cover with a adhesive layer, which formed by coating a hot-melt adhesive on the inner face near a spine connecting a front board and a back board, and pasting the papers to the cover.

2. Description of the Related Art

Various finishers designed for performing various additional works on papers with an image formed surface, which are outputted from an image forming apparatus such as a printing machine or copying machine, have been proposed recently (U.S. patent application Ser. No. 08/821,444). The term "additional works" as used herein refers to various works such as sorting papers into sheaves of sheets, binding each of the sheaves with staples, doubling, creasing, or Z-folding and punching holes in the sheaf for filing.

Incidentally, the cover with a adhesive layer, which formed by coating a hot-melt adhesive on the inner face near a spine connecting a front board and a back board, has come onto the market. Further, the bookbinding technique, which produces a bound leaflet by inserting papers into the cover, giving the thermal processing to the adhesive layer of the cover, and pasting the cover and the papers, has been known. The bookbinding of this kind is referred to as "hot-melt binding".

Heretofore, the bookbinding by the hot-melt binding has been generally performed by manually aligning the edges of papers with a formed image, which have been outputted from an image forming apparatus, inserting the aligned papers into a hot-melt binding cover, and then placing the cover now holding the papers into an off-line heating device, namely a heating device installed separately from the image forming apparatus.

The production of bound leaflets by the hot-melt binding operation using the off-line heating device, however, necessitates manual works in numerous phases. That is to say, this operation has the disadvantage of poor operational efficiency because it calls for constant human attendance.

As stated in U.S. Pat. No. 4,586,640 and U.S. Pat. No. 5,213,317, a binding device, which makes a book by fixing a hot-melt type adhesive tape on the spine of a document, and which is connected to the image forming apparatus, has been heretofore proposed. A finisher, which is linked to an image forming apparatus, and which makes a book by using the commercially available hot-melt binding cover, has never existed to date.

When a finisher designed to attain automatic bookbinding by the use of the commercially available cover is developed at all, it has the problem that, since the allowable paper binding capacity of the cover is fixed, any attempt to bind in the cover such a number of papers as exceeds the capacity encounters an inconvenience.

In short, the number of papers to be stored in the cover and pasted thereto is limited because of a fixed spine width of the commercially available cover. When papers outputted from a copying machine or a printing machine are automatically conveyed into the cover, there is a possibility that the total of the papers exceeds the allowable paper binding capacity of the cover and infallible adhesion of the papers and the cover is not accomplished.

Further, in the process of bookbinding, the cover now holding the papers must be heated so as to uniformly melt the adhesive on the cover spine. In the conventional manual bookbinding operation, the possibility of this operation suffering from inferior adhesion of papers has been relatively small. Because the operator of the apparatus follows the rule of continuing the operation while making sure that the adhesion has been attained infallibly with due respect to the melting state of the adhesive and the temperature and the heating time of the thermal processing. In the automatic operation, the elaborate work of making sure that the adhesion has been attained infallibly deprives the significance of automation. The automation, therefore, is required to discern automatically whether or not the heating temperature is appropriate and whether or not the adhesive is melted uniformly.

Besides, the problem that the papers fall off the cover after the bookbinding operation is completed will ensue if the papers are not satisfactorily pasted to the spine of the cover. In this case, part of the adhesive adheres to the edges of the fallen papers and possibly renders the papers no longer usable. Further, the adhesive on the cover spine possibly melts partly and deprives itself of usability. In short, the problem of wasting the papers and the cover will inevitably arise.

SUMMARY OF THE INVENTION

An object of this invention is to provide a finisher, which is connected to an image forming apparatus such as a copying machine or printing machine, and which is enabled to make a book by the use of a commercially available hot-melt binding cover. Another object of this invention is to provide a method for producing a bound booklet of papers outputted from the image forming apparatus, which uses a commercially available hot-melt binding cover.

In short, the invention is aimed at facilitating and expediting a series of works ranging from the stage of printing papers or forming documents through the stage of bookbinding.

And further, one object of this invention is to provide a finisher, which has the function of automatic bookbinding capable of preventing such a number of papers as exceeds the allowable paper binding capacity of the cover from being bound, or preventing the adhesive from being heated insufficiently during the process of pasting papers to the cover and put to use in the bookbinding. Another object of this invention is to provide a method of for automatically producing a bound booklet, which is capable of preventing such a number of papers as exceeds the allowable paper binding capacity of the cover from being bound, or preventing the adhesive from being heated insufficiently during the process of pasting papers to the cover and put to use in the bookbinding.

In short, the invention is also aimed at separately setting in detail the heating temperature and the time for manually performing the thermal processing and allowing the number of papers inserted inside the cover to be increased or decreased to suit the occasion when the thermal processing during the process of bookbinding ought not be performed automatically.

One aspect of this invention concerns a finisher connected to an image forming apparatus for forming an image on papers such as recording medium, and performing various additional works on papers with an image formed face outputted from the image forming apparatus, which comprises a binding device, which produces a bound booklet by inserting papers outputted from the image forming apparatus into a cover with an adhesive layer coated on an inner surface near a spine interconnecting a front board and a back board of the cover, and pasting the cover and the papers.

Another aspect of this invention concerns a method for producing a bound booklet, which comprises a step of forming an image on recording medium as a paper, a step of inserting the papers into a cover, and a step of pasting the papers and the cover.

Another aspect of this invention concerns a method for producing a bound booklet, which comprises a step of extracting one of covers stored in a cover storage unit and conveys the cover, a step of holding the conveyed cover in an opened state capable of accepting papers, a step of inserting papers into the held cover, and a step of pasting the papers and the cover.

Another aspect of this invention concerns a finisher connected to an image forming apparatus for forming an image on papers such as recording medium, and performing various additional works on papers with an image formed face outputted from the image forming apparatus, which comprises a discharging unit, which inserts papers from the image forming apparatus into a cover including a front board and a back board and discharges the cover and the papers, which is merely inserted within the cover.

Another aspect of this invention concerns a method for producing a bound booklet, which comprises a step of forming an image on recording medium as a paper, a step of inserting the papers into a cover, and a step of discharging the papers and the cover without adhesion.

Another aspect of this invention concerns a method for producing a bound booklet, which comprises a step of extracting one of covers stored in a cover storage unit and conveys the cover, a step of holding the conveyed cover in an opened state capable of accepting papers, a step of inserting papers into the held cover, and a step of discharging the papers and the cover without adhesion.

The objects, features, and characteristics of this invention other than those set forth above will become apparent from the description given herein below with reference to preferred embodiments illustrated in the accompanying drawings.

DETAILED DESCRIPTION OF THE PREFERRED EMBODIMENT

Now, the embodiments of the finisher according to this invention will be described with reference to the accompanying drawings.

First Embodiment

Figure 1:
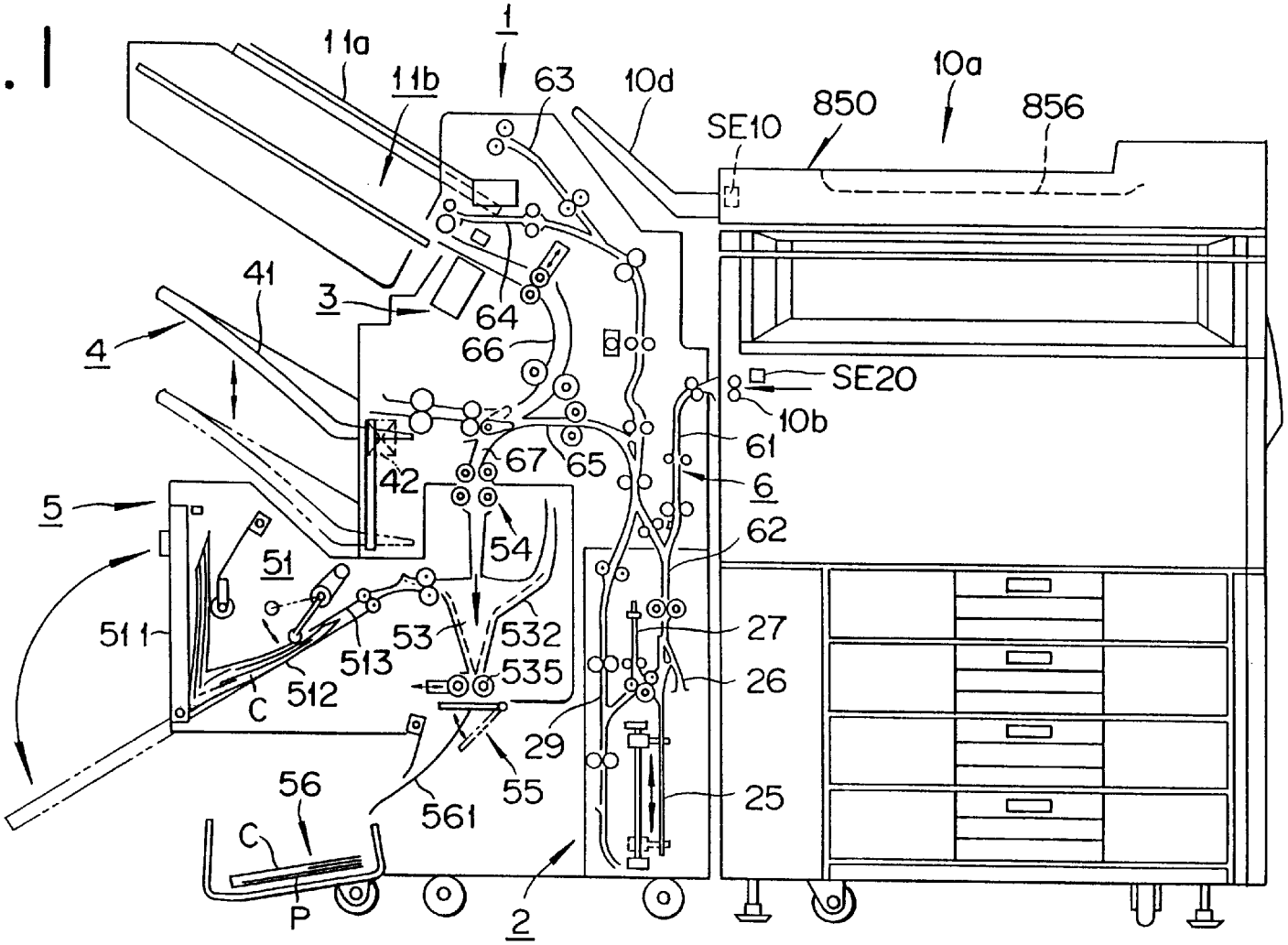
FIG. 1 is a schematic cross section as an explanatory diagram illustrating one embodiment of the finisher of this invention attached to a copying machine.
Figure 2:
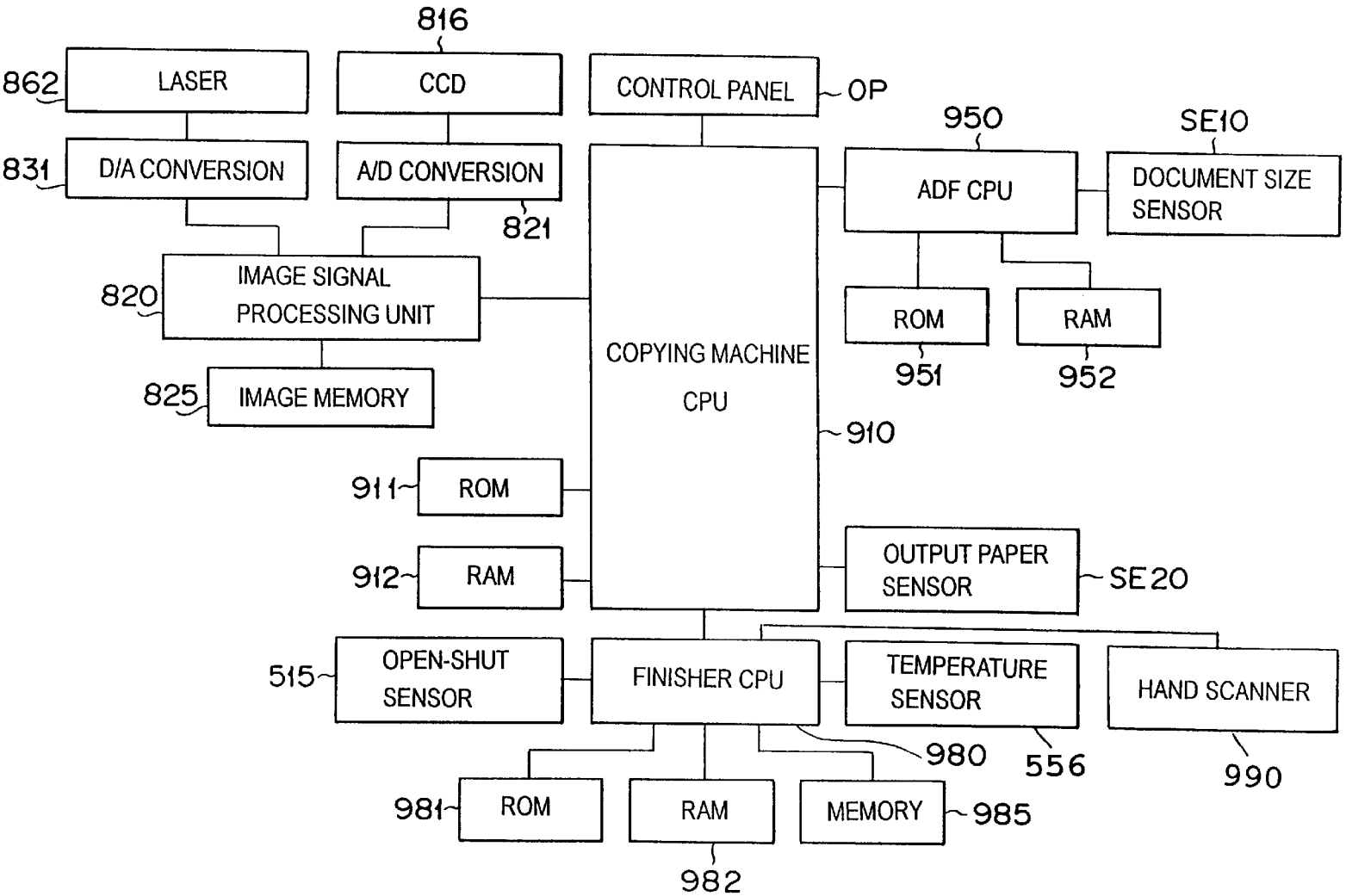
FIG. 2 is a block diagram illustrating the control system for the copying machine and the finisher.
Figure 3:
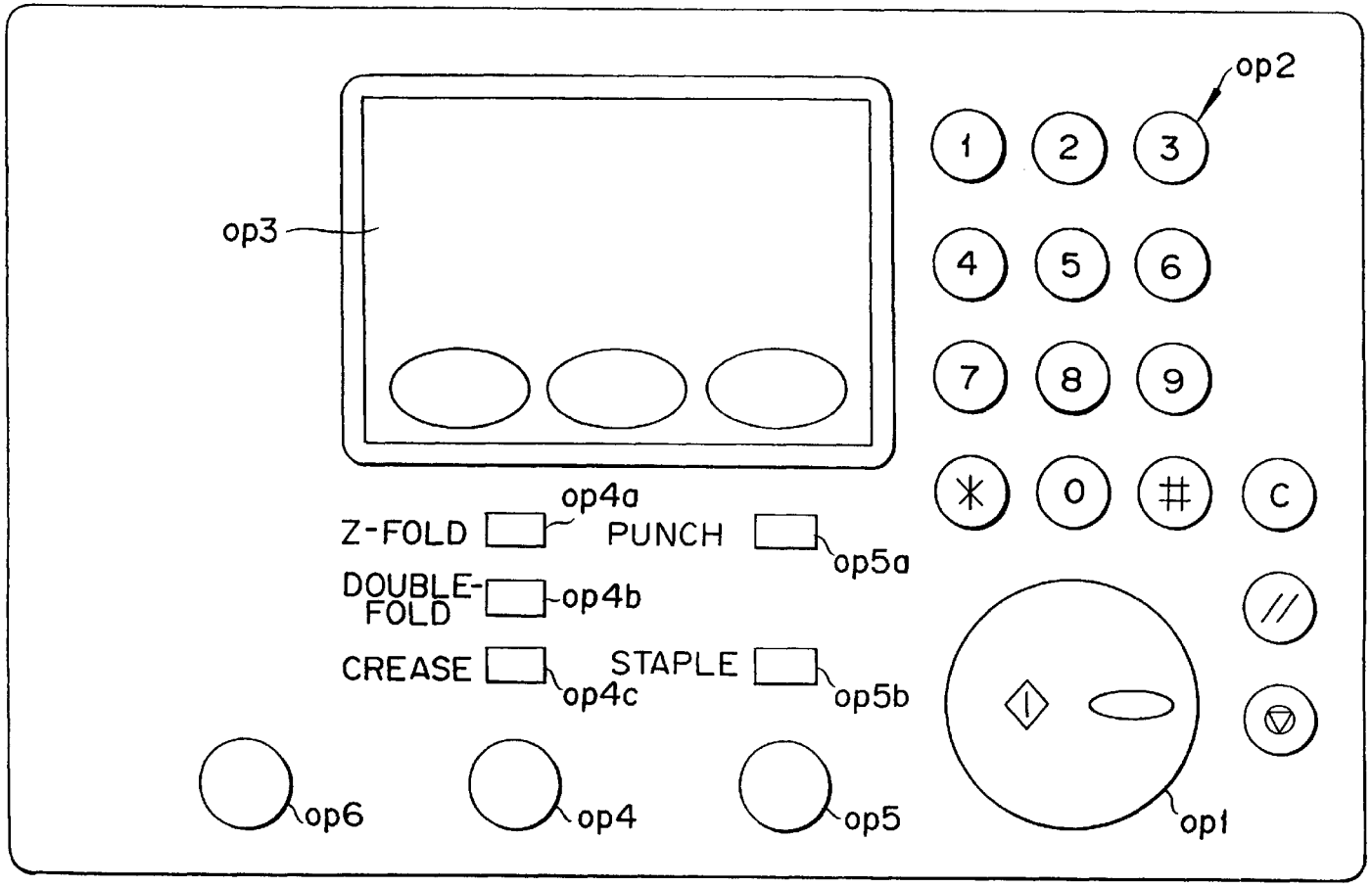
FIG. 3 is a diagram illustrating one example of a control panel provided for the copying machine.
Figure 4:
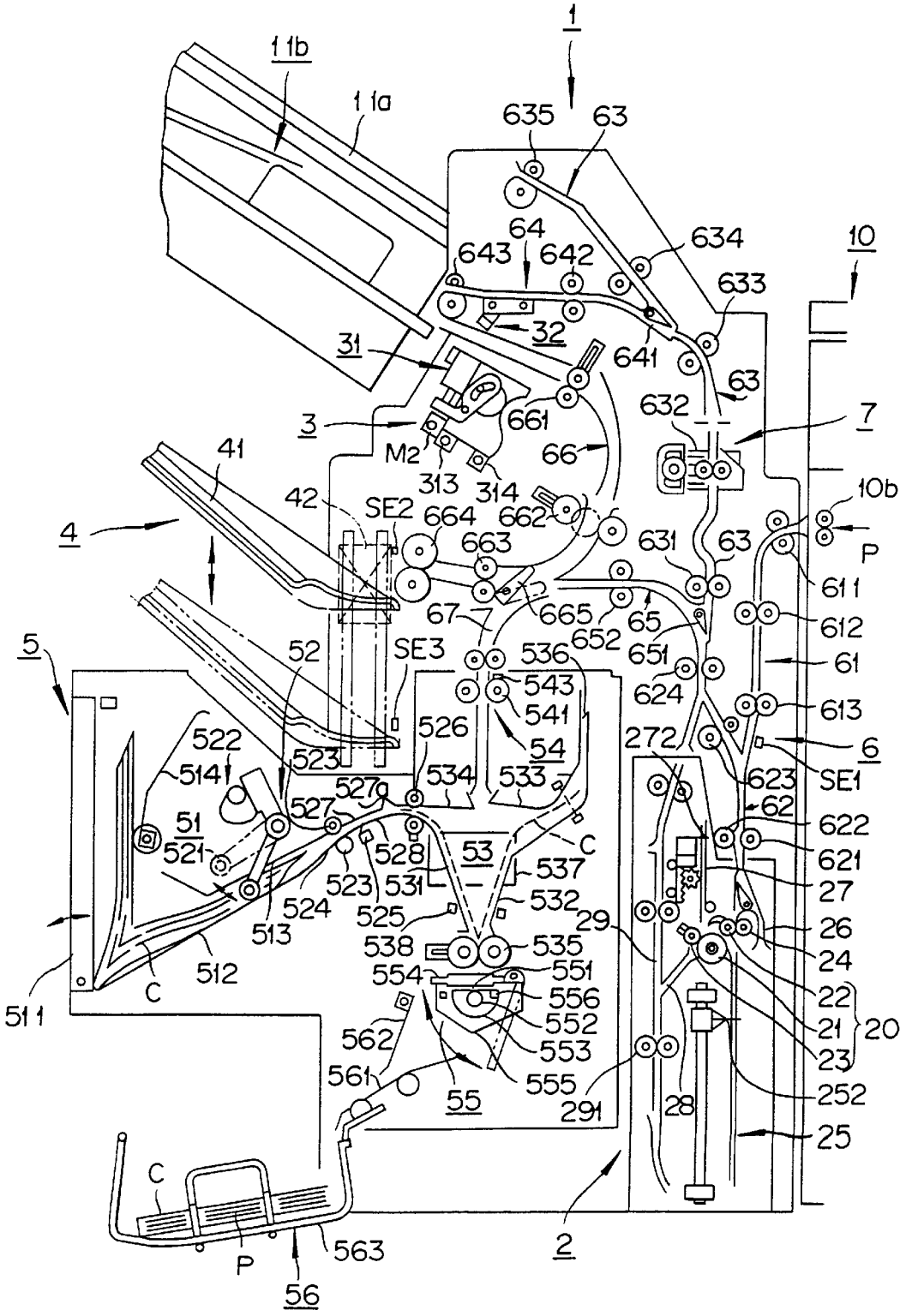
FIG. 4 is a schematic explanatory diagram illustrating the essential part of the finisher.
Figure 5:
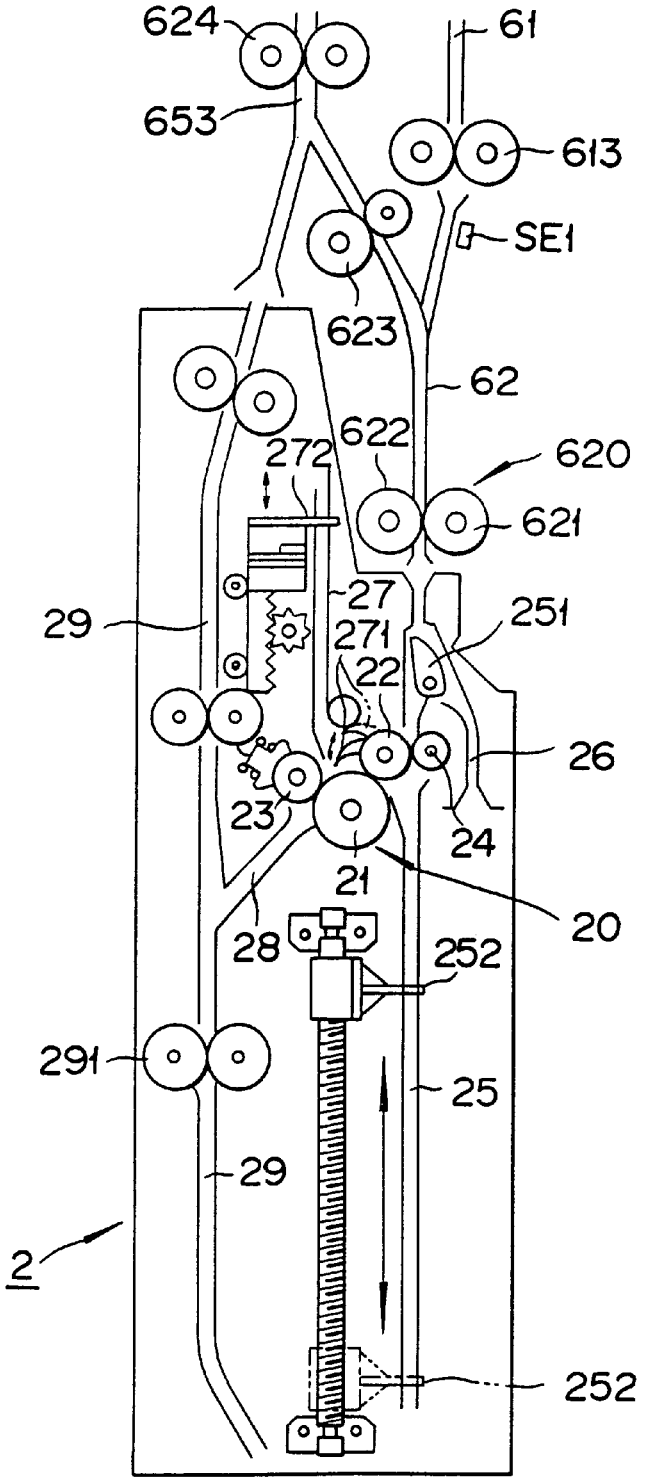
FIG. 5 is a schematic explanatory diagram illustrating a folding device of the finisher.
Figure 6:
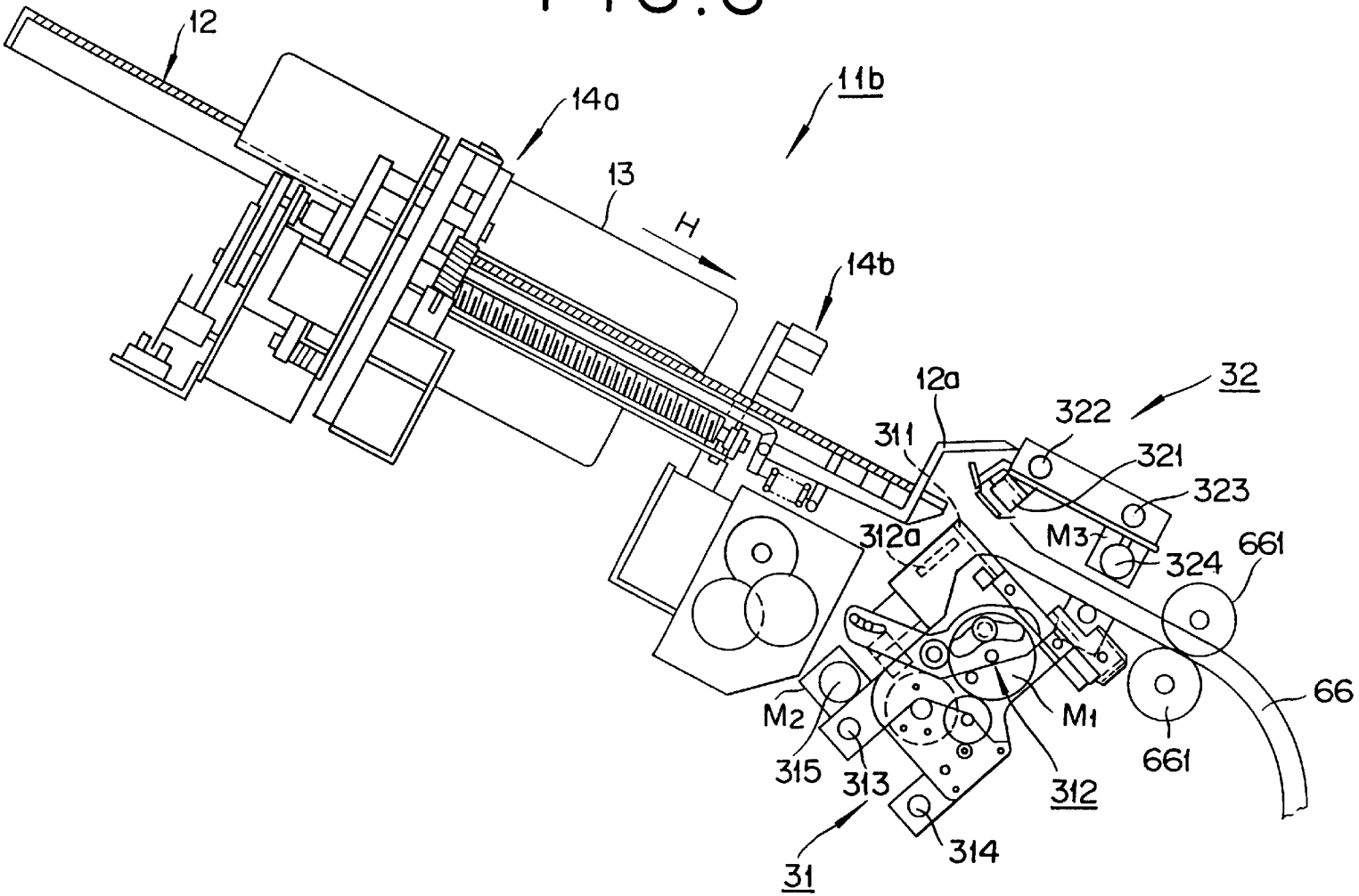
FIG. 6 is a schematic explanatory diagram illustrating a paper stacking section and a stapling device of the finisher.
Figure 7:
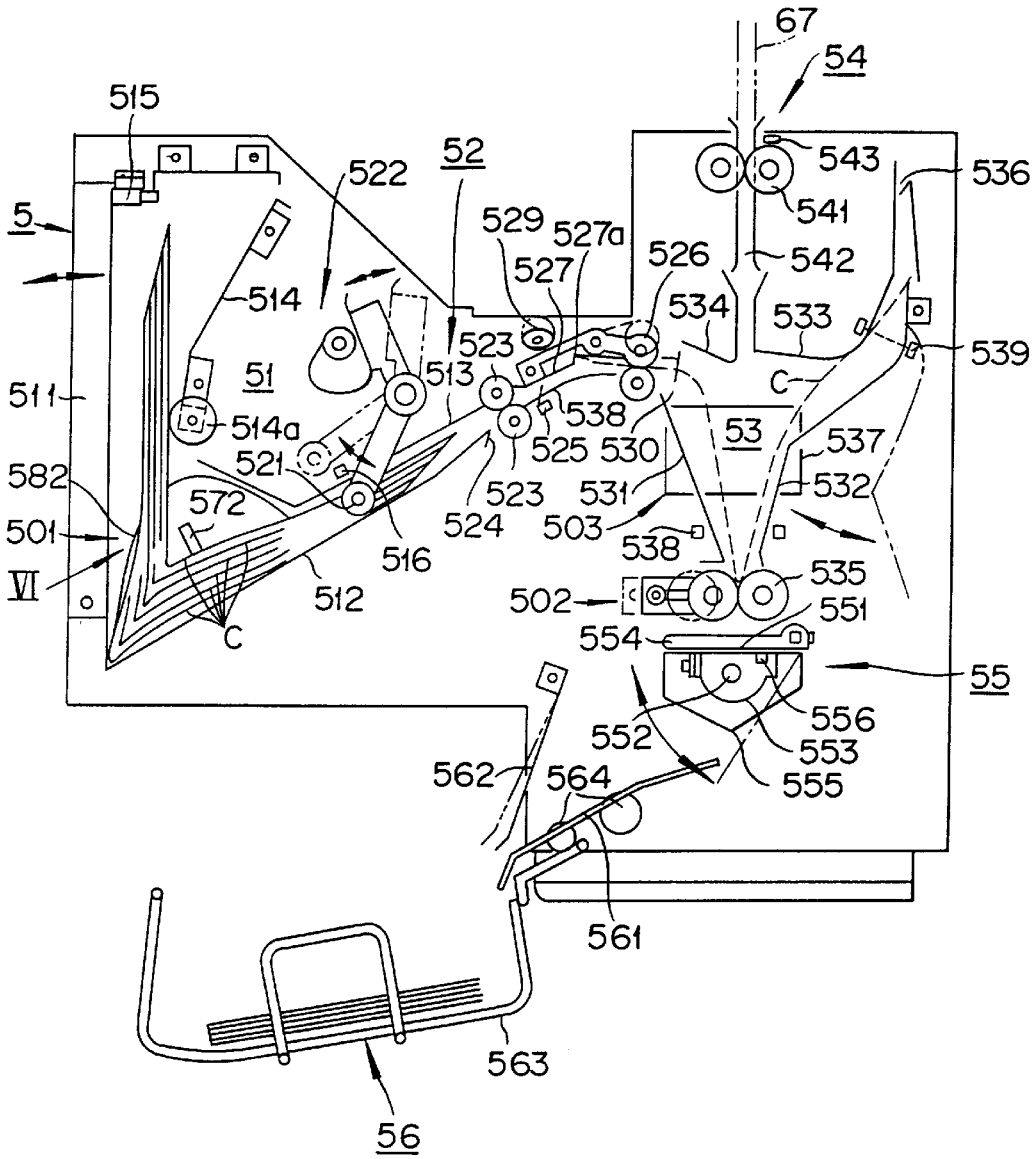
FIG. 7 is a schematic explanatory diagram illustrating a binding device of the finisher.

FIG. 1 is a schematic cross section as an explanatory diagram illustrating one embodiment of the finisher of this invention attached to a copying machine, FIG. 2 is a block diagram illustrating the control system for the copying machine and the finisher, FIG. 3 is a diagram illustrating one example of a control panel provided for the copying machine, FIG. 4 is a schematic explanatory diagram illustrating the essential part of the finisher, FIG. 5 is a schematic explanatory diagram illustrating a folding section of the finisher, FIG. 6 is a schematic explanatory diagram illustrating a paper stacking section and a stapling device of the finisher, and FIG. 7 is a schematic explanatory diagram illustrating a binding device of the finisher.

Overall Structure of Copying System

A copying machine 10 to which a finisher 1 is connected is to form an image on a paper and output a reproduction of paper one by one from a output section 10*b* in accordance with the generally known electrophotographic technique. The copying machine 10 has an automatic document feeder 850 (hereinafter referred to as "ADF") set in position in the upper side. This ADF 850 is to feed documents set as stacked on a tray 815, one by one onto a platen glass (not shown) of the copying machine 10 and, after the image thereon has been read out, discharge the document onto a tray 856 to be stacked thereon.

An image reader (not shown) built in the copying machine 10 reads an image on the document, which is set in position on the platen glass as by the ADF 850, and converts the image into a digital data and stores the digital data in an image memory on the control unit. The copying operation also includes necessary processing to the reading-out image data, such as making a dimensional modification (reducing or enlarging), changing the order of pages, reversing an image, and copying an image on the front and rear surfaces of page. The ADF 850 is provided with a document size sensor SE10 for detecting the size of a document which has been read in. The document size sensor functions when the relevant document is in process of conveyance.

The control system for the operation of the whole copying machine (including the ADF and the finisher) is composed of a CPU 910 for controlling the copying machine 10, a CPU 950 for controlling the ADF 850, and a CPU 980 for controlling the finisher 1 as illustrated in FIG. 2. The CPUs 910,950 and 980 are provided with ROM 911, 951 and 951 for storing necessary programs and RAM 912, 952 and 982 for a working memory area of the relevant CPU, respectively.

To the CPU 910 are connected a control panel OP and an image signal processing unit 820. In brief, the CPU 910 controls the operation of the various parts of the copying machine. The image signal processing unit 820 is connected to a CCD sensor 822 of the image reader through an A/D converter 821 and to a laser beam source 862 for an image forming system through a D/C converter 831. The image signal processing unit 820 is provided with an image memory 825 for storing the image data, which has been read out.

The CPU 910 for the copying machine is connected to a 10 output paper sensor SE20, which is disposed near the output section 10*b* of the copying machine 10, for counting the number of papers, which have undergone the copying operation and are outputted.

The CPU 980 for the finisher is connected to a temperature sensor 556 for detecting the temperature of the heating unit of the binding device. Further, the CPU 980 is connected to a non-volatile storage 985, for instance, which is composed of flush memory and PROM (EPROM, EEPROM, etc.) for storing such data as the cover size and the allowable paper binding capacity of the cover in the cover storage procedure, which will be specifically described hereinbelow. The CPU 980 is also connected to an open-close sensor 515 for detecting the door opening and shutting of the binding device, which will be specifically described herein below is.

The CPU 950 for the ADF is connected to the document size sensor SE10 for detecting the document size.

As illustrated in FIG. 3, the control panel OP disposed on the copying machine 10 is provided with various operating keys such as a print key op1 for ordering start of copying, a ten key op2 for inputting the number of copies and a set value, a touch panel op3 as a liquid crystal display for displaying a message and setting various details, a fold select key op4 for selecting the manner of folding papers and relevant display lamps op4*a*, op4*b* and op4*c*, a work select key op5 for ordering stapling and punching and relevant display lamps op5*a* and op5*b*, and a binding key op6 for ordering bookbinding. For instance, when the bookbinding is ordered with the control panel OP, the select key op6 is manipulated to select bookbinding and the touch panel op3 is utilized to set various particulars such as a mode of combining bookbinding with stapling (bookbinding after stapling) or a mode of inserting papers in a cover without the subsequent adhesion.

The control panel OP is controlled by the CPU 910 for the copying machine. The CPU 910 judges the input through a varying operating key, controls a relevant processing, and outputs the current status of the processing and a varying relevant message on the touch panel op3.

General Structure of Finisher

The finisher 1, as illustrated in FIG. 1, is generally composed of a non-sort tray 11*a* and a stacking section 11*b*, which stack and align papers P discharged from the output section 10*b* of the copying machine 10, a folding device 2, which gives, when necessary, such folding works as doubling or folding in three in the shape of the letter Z (Z-Folding) to the paper P discharged from the output section 10*b*, a stapling device 3, which is disposed on the downstream side in the conveying direction of the stacking section 11*b* and gives a stapling to the papers P which have been stacked and aligned, a sorting section 4, which receives and stores a stapled sheaf of papers or a sheaf of papers which has not undergone the stapling, a binding device 5, which attaching a cover to the stapled sheaf or the sheaf which has not undergone the stapling, and a punching device 7, which is disposed in the path for conveyance of papers and used, when necessary, to punch the papers. The papers which have been outputted from the copying machine 10 are conveyed by a conveying section 6 to various devices in the finisher.

Paper Conveying Section

The paper conveying section 6, as illustrated in FIG. 1, is composed of a conveying route 61, which receives the papers from the output section 10 of the copying machine 10 and conveys them downward, a switchback conveying route 62, which reverses the papers P front side back and upside down, a conveying route 63, which conveys the papers P to the non-sort tray 11*a*, a conveying route 64, which is branched from the conveying route 63 and conveys the papers P to the paper stacking section 11*b*, a conveying route 65, which is branched from the substantially leading end of the conveying route 63 and conveys the papers P to the binding device 5 or the sorting section 4, and a conveying route 66, which conveys a sheaf of papers from the stacking section 11*b* to the sorting section 4 or the binding device 5. The papers P are conveyed through these conveying routes along their centers as the standard.

To be more specific, as illustrated in FIG. 4, the conveying route 61 is possessed of conveying roller pairs 611, 612 and 613. The switchback conveying route 62 is provided with a reversible conveying roller 621, a follower roller 622, which rotates by contacting the conveying roller 621 and following the rotation thereof, conveying roller pairs 623 and 624, which convey the switched-back papers P to the conveying route 63, conveying route 64 or conveying route 65, and a sensor SE1 for detection of a paper.

The papers, which have been conveyed downward through the conveying route 61, are first led into the switch-back conveying route 62. Specifically in the folding mode, the papers are fed by the conveying roller 621 into the folding device 2 when the trailing ends of the papers P in the conveying direction are detected by the sensor SE1 and a desired time elapses, namely when the trailing ends of the papers enter the conveying route 62. After the folding, the papers are passed through a conveying route 29 and conveyed upward in the direction of the conveying route 63. In the through mode or the no-folding mode of conveying the papers directly to the non-sort tray 11*a*, the papers P are first led into a escape conveying route 26. When the trailing ends of the papers enter the conveying route 62, the conveying roller 621 is switched to a reverse rotation and the papers are conveyed upward from the escape conveying route 26 to the conveying route 63.

The conveying route 63 is provided with conveying roller pairs 631, 632, 633 and 634, a discharge roller pair 635, and the punching device 7, which punches holes in the leading edge or the trailing edge of the papers P. The punching device 7, in response to a command to punch, is actuated to punch the papers.

The conveying route 64 is provided with a switch claw 641, a conveying roller pair 642, and a discharge roller pair 643. The conveying route 65 is provided with a switch claw 651, which switches the destination of the papers, and a conveying roller pair 652. These switch claws 641, 651 are severally rotated by a solenoid (not shown). The papers P which have been conveyed through the switchback conveying route 62 are guided by the switch claw 651 to either the conveying route 63 or the conveying route 65. The papers P, which have been conveyed through the conveying route 63, are conveyed continuously through the conveying route 63 or are directed to and conveyed toward the conveying route 64, depending on the switch claw 641 that is disposed halfway along the length of the conveying route 63, and then are discharged into the non-sort tray 11*a* by the discharge roller pair 635 or into the stacking section 11*b* by the discharge roller pair 643. In contrast, the papers, which have been conveyed through the conveying route 65, are not fed to the stacking section 11*b* and are directly led to the binding device 5 or the sorting section 4.

The papers P, which have been stacked and aligned at the stacking section 11*b*, are stapled, when necessary, then passed through the conveying path 66 of a relatively large size, and guided to the binding device 5 or the sorting section 4. The conveying route 66 is provided with mutually separable conveying roller pairs 661, 662 and 663, and a discharge roller pair 664 which is disposed at the leading end.

Sorting Section

The sorting section 4, as illustrated in FIG. 4, is provided with a sort tray 41 and a drive mechanism 42 for lifting this sort tray 41. The sort tray 41 receives the papers P, which are fed one by one through the conveying route 65 during the process of copying a plurality of documents, or the sheaf, which have been led from the paper stacking section 11*b* to the stapling device 3 and are fed through the conveying route 66 after stapling. The papers P conveyed through the conveying route 65 or the sheaf conveyed through the conveying route 66 is guided by a switch claw 665 to the sort tray 41 or the binding device 5.

The tray 41 is lowered by a fixed amount at a time by the drive mechanism 42 each time a sensor SE2 detects an incoming paper P for stacking. The copying motion is interrupted when a sensor SE3 detects the fact that the tray 41 has been lowered to the lower limit, or the tray 41 has been filled to capacity. The construction of the drive mechanism 42 for lowering the tray 41 by a fixed amount at a time has been generally known and, therefore, will be omitted from the following description.

Folding Device

The folding device 2, as illustrated in FIG. 1 and FIG. 4, is disposed directly below the conveying section 6 in such a manner that it is freely attached to and detached from the finisher 1. Further, the folding device 2 has the function of doubling the paper P, which already has an image formed face, in the center in the conveying direction, the function of creasing the paper P, or opening the doubled papers P and leaving a crease in the center, and the function of Z-Folding the papers P, or folding in three.

Key parts of the folding device 2 are a folding section 20 with three reversible rollers 21, 22 and 23, and a backup roller 24. The papers P are transferred by the paper conveying routes 25–29 as centered around the rollers 21–24.

The folding device 2, as illustrated in detail in FIG. 5, is provided with the escape conveying route 16, which allows the papers P to be switched back at a switchback section 620 without folding, the first conveying route 25, which receives the papers P from the switchback section 620 and performs the first folding, the second conveying route 27, which performs the second folding, the folding section 20, which performs several kinds of folding, a switchback roller pair 291, which reverses the folded papers P upside down, the third conveying route 28, which conveys the reversed papers P to the switchback roller pair 291, and the switchback conveying route 29, which conveys the papers that have been reversed upside down by the switchback roller pair 291.

The folding device 2 is further provided with a first stopper 252, which comes in contact with the leading ends of the papers P and forms a loop of the papers P for the first folding and a second stopper 272, which similarly forms a loop of the papers P for the second folding. In short, the folding of the papers P is performed by nipping the loop of the papers with the folding rollers 21, 22 and 23. There are also provided a first stopper drive motor and a second stopper drive motor (not shown) as drive sources capable of moving the first stopper 252 and the second stopper 272 independently in the directions indicated by an arrow mark in the diagram.

The folding modes will be generally described. The folding device 2 is possessed of three folding modes which are selectable by the operation of the control panel OP of the copying machine 10.

[1] Z-Fold Mode

This mode functions to fold the papers P in three in the shape of the letter Z. The paper P, which has been fed from the output section 10*b* through the conveying routes 61 and 62, is passed through a switching device 251 and conveyed toward the first conveying route 25 by the motion of the switchback roller pair 621 as illustrated in FIG. 5. It is, however, brought to a temporary stop by the folding roller 22 and the backup roller 24 which are currently at rest. When the folding roller 2 is set driving, the paper is conveyed until it comes in contact with the first stopper 252, which is set in position. The paper P, on coming in contact with the first stopper 252 is caused to form a loop near the folding rollers 21, 22. The loop is nipped in the gap between the folding roller 21 and 22 as the first folding.

Owing to the switching motion of a switching device 271 in response to a Z-Fold signal outputted from the copying machine 10, the paper P, which has undergone the first folding, is conveyed to the second conveying route 27 until it comes in contact with the second stopper 272. The paper P, which has been stopped by the second stopper 272, forms a loop near the folding rollers 21, 23. The loop is nipped in the gap between the folding roller 21 and 23 as the second folding. The paper P, to which the second folding and Z-Folding have been given, is conveyed to the third conveying route 28. Thereafter, the paper P is conveyed to the switchback conveying route 29 and directed to the conveying route 63 by the reverse of the switchback roller pair 291.

[2] Center-Fold (Cover-Binding) Mode

This mode functions to double the paper P in the center. This mode carries out the first folding by following the procedure of the Z-Fold mode while placing the first stopper 252 at a position different from that used during the first folding in the Z-Fold mode.

The paper P, which has undergone the first folding, is directly conveyed toward the nip between the folding rollers 21 and 23. Because the switching device 271 disposed at the entrance to the second conveying route 27 has not been turned so as to guide the paper P to the second conveying route 27. In short, the paper P, which has been discharged from the folding rollers 21 and 22, is immediately caught in the nip between the folding roller 21 and 23, and conveyed as it is to the third conveying route 28. The paper P is conveyed to the switchback conveying route 29, reversed upside down by the switchback roller pair 291 in the same way as in Z-Fold mode, and then conveyed toward the conveying route 63.

[3] Center-Bind Mode

This mode functions to crease the center of the stacked papers P for stapling as in a weekly magazine. The paper P, which is fed from the output section 10*b*, is conveyed toward the first stopper 252 of the first conveying route 25, which is so positioned as double the paper P in the center, depending on the size of the paper P, similarly to the center-fold mode. When a loop is formed, the loop is caught in the nip between the rollers 21 and 22 which perform the first folding. The paper P is continuously conveyed downward until the set time of the timer, which started at the time that the sensor SE1 disposed on the upstream side detects the trailing end of the paper P, elapses. After the elapse of the set time, the folding rollers 21, 22 and the switchback roller pair 621, which have been rotating for conveying the paper P toward the downstream side, are reversed. As a result, the folded portion of the paper P is discharged from the nip between the folding rollers 21 and 22. And the paper P is opened with the crease still remaining in the center. Then the paper P is switched back, again conveyed toward the upstream side with the former trailing end at the lead, passed through the conveying route 64, and conveyed to the stacking section 11*b*.

Stapling Device

As illustrated in FIG. 4 and FIG. 6, the stapling device 3 is to staple, at a desired position, a sheaf of papers which have been discharged from the conveying route 64 and aligned at the paper stacking section 11*b*. The stapling device 3 is possessed of a head unit 31, which drives out staples, and a base unit 32, which receives each staple driven out of the head unit 31 and bends it into a desired shape.

At the stacking section 11*b*, an end stopper 12*a* stops and aligns the leading ends of the papers P discharged on tray 12 (the trailing ends as viewed from the discharging direction into the tray 12), and a side aligning plate 13 aligns the papers P in the lateral direction by the reciprocating motion in a direction perpendicular to the conveying direction. In the center-fold (cover-binding) mode, therefore, the sides of paper containing the creases fall on the side of the end stopper 12*a*. Then, a first chuck device 14*a* and a second chuck device 14*b* alternately nip the side of the papers P and prevent the papers P from floating up. Further, the first chuck device 14*a* is so designed to keep hold of the sheaf and advance it toward the stapling device 3. Incidentally, the prevention of floating up of the papers P is effective in not only increasing the capacity of the tray 12 for stacking papers but also storing such papers, which have undergone the doubling (center folding) or Z-Folding with the folding device 2.

The head unit 31 is designed to actuate a separating device and a bending device 312*a* through a cam link mechanism 312 driven by a motor M1 and thrust the staple separated from a cartridge 311 toward the base unit 32. The base unit 32 is possessed of a support 321, which bends the staple in the shape of three sides of a square and fastens or binds the sheaf.

The stapling positions in the direction perpendicular to the conveying direction H are decided by the motions of the head unit 31 and the base unit 32. To be specific, the head unit 31 is moved by the reversion of a spiral shaft 315, which is mounted slidably on two guide shafts 313,314 and disposed in the direction perpendicular to the conveying direction H, and driven by a stepping motor M2. The base unit 32 is moved in the direction perpendicular to the conveying direction H in consequence of the reversion of a spiral shaft 324, which is mounted slidably on two guide shafts 322,323 and driven by a stepping motor M3.

The stapling positions in the conveying direction are decided by the motion of the first chuck device 14*a*. The stapling, therefore, can be performed on the leading end or the trailing end of the stacked papers, depending on the amount of thrust of the first chuck device 14*a*. In the case of the cover-binding, the edge of a doubled paper (the leading end as viewed from the discharging direction into the tray 12) is pushed out until it reaches the position of the head unit 31.

The sheaf of papers, after undergoing the stapling, is nipped by the mutually separable conveying roller pair 661 and conveyed through the conveying route 66.

All these functions of the stapling device have been widely known to the art (U.S. patent application Ser. No. 08/821,444) and do not need to be described in detail any further.

Binding Device

The binding device 5 is to bind the papers outputted from the copying machine and paste the sheaf to a hot-melt binding cover C which is available in the market. More specifically, it has the function of manufacturing a booklet having the cover C and the paper bound together (hereinafter referred to as "bound booklet") by inserting the papers outputted from the copying machine 10 into the cover C, and giving the heat-treating to the cover C and the papers together, and pasting the papers and the cover C. The incorporation of the binding device 5 in the finisher 1, therefore, enables all the operations ranging from the printing through the bookbinding to be performed consistently.

The cover comprises a front board, a back board, a spine interconnecting these leaves and a adhesive layer formed by coating or fixing a hot-melt adhesive on the inner surface near the back.

The cover of this description is known in various types, including a cover using opaque sheets (cardboard papers, for instance) for the front board and the back board, a cover using a transparent sheet for one of the leaves (the front board, for instance) and an opaque sheet for the other leaf, and a cover using transparent sheets for the front board and the back board.

The binding device 5, as illustrated in FIG. 4 and FIG. 7, is composed of a cover storage unit 51, which stores a plurality of binding covers, a cover conveying unit 52, which extracts one cover C from the cover storage unit 51 and conveys this cover C, a paper insertion unit 53, which holds the cover C conveyed from the cover conveying unit 52 in a state capable of accepting papers, a paper conveying unit 54, which conveys and inserts the papers from the copying machine 10 into the cover C held in position in the paper insertion unit 53, a heating unit 55, which gives thermal processing to the adhesive layer of the cover C with inserted papers at the paper insertion unit 53, and a discharging unit 56, which discharges a bound booklet completed by the thermal processing, outside the binding device and stores the bound booklet.

Now, the whole operation of the binding device 5 constructed as described above will be generally delineated below. Only one of the covers C stored in the cover storage unit 51 is extracted by the cover conveying unit 52 and conveyed toward the paper insertion unit 53. The paper insertion unit 53 receives this cover C and holds it in an opened state capable of accepting papers. The papers, which have been conveyed by the paper conveying unit 54 from the copying machine 10, are inserted into the cover C. Then, the heating unit 55 gives the thermal processing to the adhesive layer of the cover now holding the inserted papers. The completed bound booklet is conveyed from the heating unit 55 to the discharging unit 56 and received by the discharging unit 56. It results in realizing the bookbinding utilizing the commercially available hot-melt binding cover.

Incidentally, the finisher 1 of the present embodiment is provided with the conveying routes 65, 67 as the first paper conveying route, which conveys the papers from the copying machine 10 one by one to the binding device 5, and the conveying routes 66, 67 as the second paper conveying route, which conveys the sheaf or the plurality of papers, which have been outputted from the coping machine 10 and temporarily stacked the stacking section 11*b*, to the binding device 5.

For brevity of description, the papers P or the sheaf which has been conveyed in the conveying route 67 will be hereinafter written occasionally as "paper/sheaf".

The sheaf aligned at the stacking section 11*b* is directly, or after undergoing the stapling, conveyed through the conveying routes 66, 67 to the binding device 5 and bound therein. The binding is carried out on the sheaf in an unfolded state and may be performed likewise on the sheaf, which have been folded by the folding device 2. The papers in a folded state are conveyed one by one through the conveying route 65 to the binding device 5 and bound therein. Even when no folding work is involved, the papers P discharged from the output section 10*b* may be brought in one by one through the conveying route 65 and, after they have totaled a desired plurality, subjected to the binding. Optionally, the cover C and the sheaf without the thermal processing at the heating unit 55 may be discharged in an unbound state to the discharging unit 56. In this mode of use, the covers C may be used for sorting the papers in a stacked state and producing sorted copies.

The present embodiment is characterized by the construction of the binding device 5. Now, the essential components of the binding device 5 will be sequentially described in detail below.

[1] Cover Storage Unit 51

In the cover storage unit 51, a space for storing the covers C is composed of a switching door 511, a retaining base 514, a lower guide 512, and an upper guide 513. In feeding a cover C to the storage space, the switching door 511 is opened (in the state indicated by an alternate long and short dash line in FIG. 1), the group of covers is opened, and the rear and the front board of the cover C are made to form the shape of the letter V, with the back board mounted on the lower guide 512 and the front board pressed against the retaining base 514. The lower guide 512 and other parts are so designed that when the group of covers have been stored, the back board of the cover C assumes a horizontal posture or the cover spine assumes a downwardly inclined posture. For the purpose of reducing the resistance during the conveyance of the cover C, a roller 514*a* which comes into sliding contact with the front board of the cover C is fitted rotatably to the lower end of the retaining base 514.

The motion of the switching door 511 is detected by the open-close sensor 515 which is formed of such devices as limit switches. The presence or absence of a cover C in the cover storage unit 51 is detected by a cover sensor 516 which is formed of such means as photosensors. When the cover sensor 516 detects the absence of a cover, the motion of the binding mode is prohibited and the operations of the another modes are allowed to proceed.

The inner surface of the spine of the cover C has an adhesive layer formed by fixing a thermoplastic adhesive material. The surface of the adhesive material is possessed of viscosity of a certain degree. When a plurality of covers care stored in an opened and superposed state, the covers care mutually stuck and are no longer easily conveyed one by one. In the present embodiment, the covers C are stored in the cover storage unit 51 as stacked in such a manner that the front and the back board of the covers C are spread to include an angle of about 90 degrees. Then, a pickup roller 521, which is disposed on the cover conveying unit 52 which will be described specifically herein below, comes in contact with the inner surface of the cover and extracts the cover from the side of the front board or the back board (the back board in the illustrated case). According to this arrangement, the part attached by viscosity to the adhesive layer of the cover is separated, and the contact between the upper cover C ready for conveyance and the adhesive layer of the lower cover C can be minimized during the conveyance of the cover C. Namely, the plurality of covers C pasted by the adhesive layer are separated and conveyed one by one.

The cover storage unit 51 is further provided with a cover front riffling mechanism 501 (equivalent to a riffling mechanism), which forcibly separates the covers mutually attached by the adhesive layer inside the cover storage unit 51.

Figure 8:
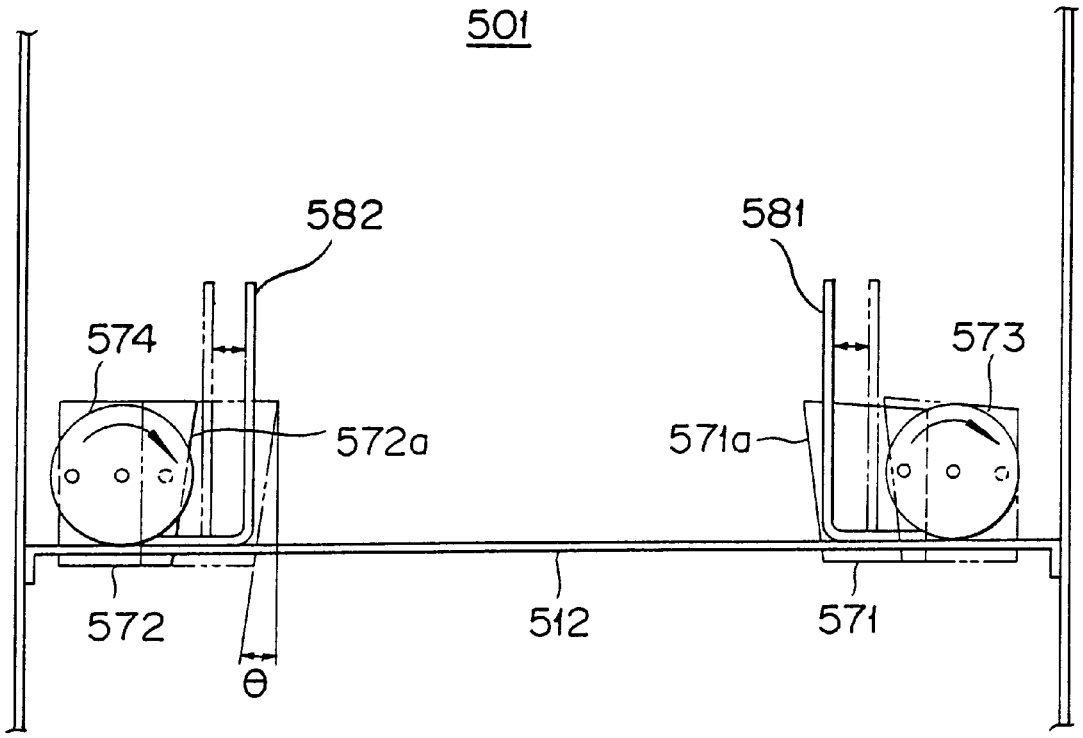
FIG. 8 is a cross section taken along the direction of an arrow mark VI of FIG. 7, illustrating a cover front riffling mechanism provided in a cover storage unit of the binding device.

FIG. 8 illustrates the cover front riffling mechanism and FIG. 7 is a cross section taken along the direction indicated by an arrow mark VI.

The cover front riffling mechanism 501 is provided with at least one pair of cover moving devices 571 and 571 (equivalent to riffling devices), which are disposed at such positions as are opposed across the group of stored covers and attached freely movably to the lower guide 512, and driving mechanism 573 and 574, which alternately drives the cover moving devices 571 and 572.

The cover moving devices 571, 572 produce a free sliding motion in the direction (the lateral direction in FIG. 8) perpendicular to the conveying direction of the cover C (the direction parallel to the surface of paper in FIG. 7) within the cover storage unit 51, and come in contact with the end face of the cover falling in the direction perpendicular to the conveying direction of the cover C. The driving mechanism 573, 574 are connected, for instance, through a link plate (not shown) to the cover moving devices 571,572 such that the rotary motion of the driving mechanism 573, 574 is converted into the sliding motion of the cover moving devices 571,572.

The cover pressing edges of the cover moving devices 571, 572 are composed of slanted pressing surfaces 571*a*, 572*a* which are inclined by a desired angle θ. Incidentally, it is repeated desired number of times, immediately before the conveyance of the cover C, that the cover moving devices 571, 572 are alternately slid to alternately press the group of covers from the direction perpendicular to the conveying direction. Accordingly, the end faces of the cover are pressed by the slanted pressing surfaces 571*a*, 572*a* and slid obliquely by an amount corresponding to the angle θ relative to the direction perpendicular to the conveying direction, with the result that the opened and stacked covers C will be separated one from the other.

The cover front riffling mechanism 501 constructed as described above, when a plurality of covers with a adhesive layer are stacked, can infallibly separate covers pasted in a stacked state by the adhesive layer and convey one by one. As a result, it is prevented that the covers C are conveyed in a superposed state or fed incorrectly and the finisher 1 incurs such inconveniences as interruption of operation.

The cover storage unit 51 is provided with a pair of cover regulating devices 581, 582, which regulates the position of the group of covers and preventing the covers in the process of conveyance from advancing on the skew. These cover regulating devices 581, 582 are attached to the lower guide 512 so as to produce a free sliding motion in the direction perpendicular to the conveying direction of the covers C. That is to say, they are so constructed as to allow the regulating position to be adjusted depending on the size of the relevant covers C stored in the cover storage unit 51.

[2] Cover Conveying Unit 52

The cover conveying unit 52, as illustrated in FIG. 7, is provided with the pickup roller 521, which comes in contact with the back of the back board of thestored cover C (directed upwardly, depending on the condition of storage) and conveys the leading end of the cover C, a roller pressing controller 522, which presses the pickup roller 521 against the cover C and separates it therefrom, riffling roller pair 523, which are disposed on the downstream side in the conveying direction of the pickup roller 521 and convey only one cover C, a front riffling device 524, which is disposed on the upstream side of the riffling roller pair 523, a cover sensor 525, which is disposed on the downstream side of the riffling roller pair 523, cover conveying roller pair 526, which are disposed on the downstream side of the riffling roller pair 523, and cover conveying guides 527 and 528, which are so constructed as to connect the cover storage unit 51 and the paper insertion unit 53.

The roller pressing controller 522 drives the pickup roller 521 in reverse out of the cover storage space when the open-close sensor 515 detects the opening of the switch door 511, and presses the pickup roller 521 against the back of the back board of the cover C when the open-close sensor 515 detects the shutting of the switch door 511.

The drive of the riffling roller pair 523 is stopped after the elapse of a desired time following the detection by the cover sensor 525 of the leading end of the cover C conveyed by the riffling roller pair 523, namely after the leading end of the cover C is infallibly nipped by the cover conveying roller pair 526. Thereafter, one of the riffling rollers 523 is rotated by following the conveyance of the cover C by the cover conveying roller pair 526, and the other of the riffling rollers 523 is brought to a stop. For this operation, the drive system of the riffling roller pair 523 is provided with a clutch. Optionally, the operation may be realized by differentiating the drive source for the cover conveying roller pair 526 from the drive source for the riffling roller pair 523.

The pickup roller 521 kept pressed against the back board of the cover C is separated from the back board of the cover C by the fact that the roller pressing controller 522 is actuated within a desired time following the detection of the leading end of the cover by the cover sensor 525, namely before the cover C is conveyed to the position at which the spine comes in contact with the pickup roller 521.

During the conveyance of a cover, when the cover C of the preceding job still remains in the paper insertion unit 53, the incoming new cover C is kept waiting temporarily on the upstream side from the cover trailing end of the preceding job and restarted toward the paper insertion unit 53 as synchronized with the discharge of the cover C of the preceding job.

Incidentally, at least one of the cover conveying roller pair 526 (the roller on the upper side in the illustrated case) is so designed as to be caused by a roller pressing controller 529 to retreat freely from the cover conveying route.

[3] Paper Insertion Unit 53

Figure 9:
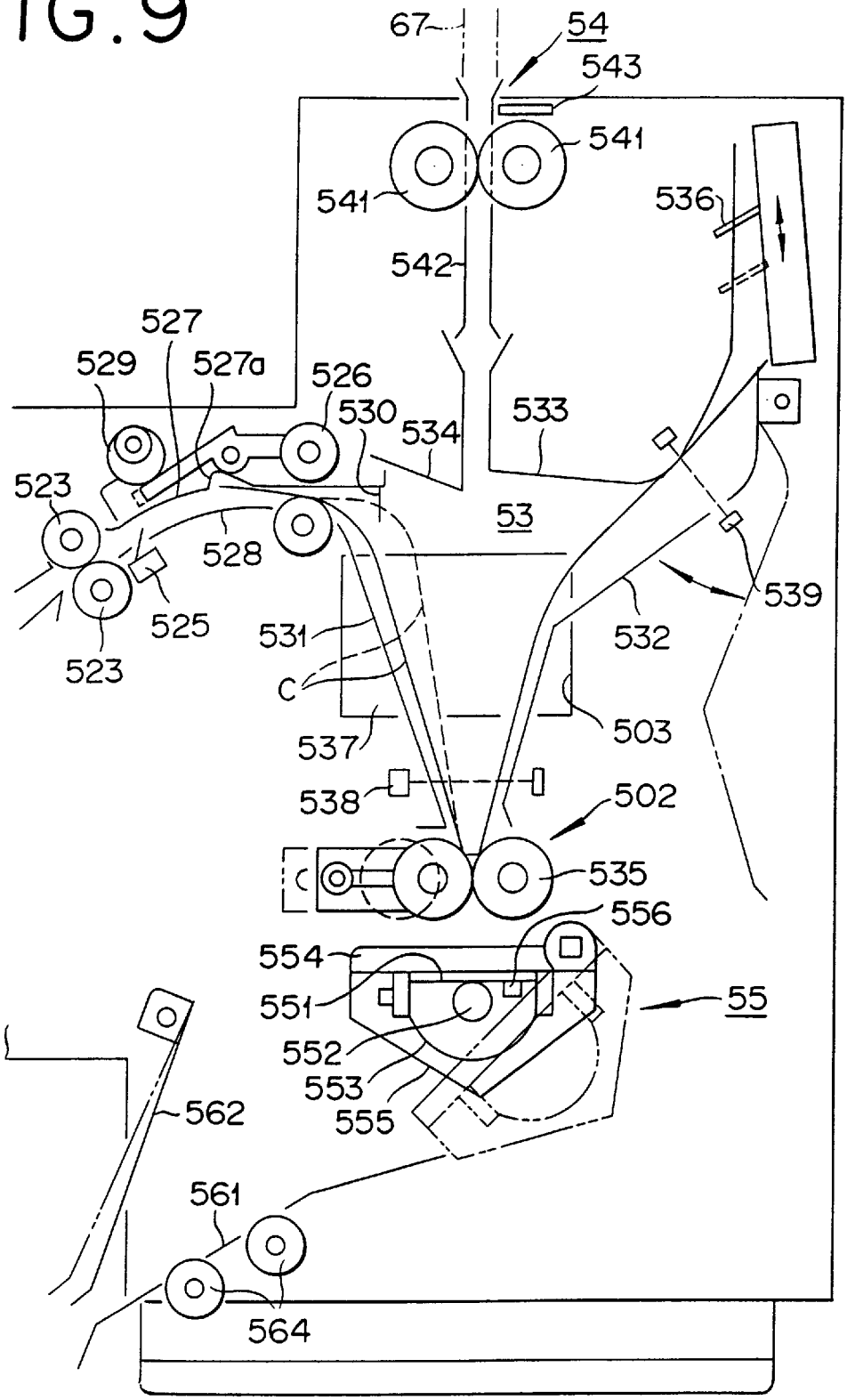
FIG. 9 is an explanatory diagram illustrating a paper insertion unit of the binding device.

The paper insertion unit 53, as illustrated in FIG. 9, is provided with guide plates 531, 532, 533 and 534, which form a paper insertion space shaped like an reversed triangle open on the upper side, a regulating device 502, which comes in contact with the spine of the cover retained in the paper insertion space and regulates the lower end position of the spine, and a leading end stopper 536 (equivalent to a stopper), which is disposed in the upper area of the paper insertion space in the cover conveying direction.

The paper insertion space is disposed below the paper conveying unit 54. The regulating device 502 is provided with a cover resist roller pair 535, which is freely rotatable and freely movable between the closed position for regulating the lower end position of the cover spine and the opened position for canceling the regulation and feeding the cover C to the heating unit 55 disposed in the lower area. Further, the binding device 5 is provided with a lateral aligning mechanism 503 (equivalent to an aligning mechanism), which aligns the cover C and the sheaf in the lateral direction (the longitudinal direction along the cover spine) in the paper insertion unit 53 before the thermal processing.

The cover conveying unit 52 conveys the cover in a substantially horizontal direction from the back board side into the paper insertion space, with the cover kept in a spread state and the adhesive layer directed upward. The leading end of the cover C, which has been conveyed from the cover conveying unit 52, advances upward along the guide plate 532 and comes in contact with the leading end stopper 536, with the result that the position of the leading end in the conveying direction will be regulated. The cover spine continues to deviate from the conveying direction as though it were bent downward as the cover conveying roller pair 526 convey the cover C with nipping it. The lower end of the cover spine, which has been passed between the guide plates 531 and 532, is regulated by the cover resist roller pair 535, which has been moved to the closed position.

At least the upper roller of the cover conveying roller pair 526 is retreated out of the cover conveying route after the elapse of a desired time following the detection of the cover spine by a cover sensor 538 disposed above the cover resist roller pair 535, namely after the cover spine has come in contact with the cover resist roller pair 535 and while the training end of the cover still remains on the upstream of the cover conveying roller pair 526. A transmission or reflection type photosensor is used as the cover sensor 538.

In consequence of the retreat of the cover conveying roller pair 526, the front board of the cover C, which has been retained by the roller pair 526, is moved to return in the direction opposite the cover conveying direction owing to the strength of the nerve of the cover C itself. Then, the cover trailing end comes into engagement with or in contact with a depressed area 527*a* formed in a cover conveying guide 527. As a result, the position of the cover trailing end C is regulated. The position of the front board prior to the retreat of the cover conveying roller pair 526 is indicated with a broken line in FIG. 7 and FIG. 9. Incidentally, the position of the front board subsequent to the retreat is indicated with a solid line in FIG. 9.

The cover C, which has been conveyed by the cover conveying unit 52, is set and retained in the paper insertion unit 53 such that the back board is in contact with the guide plate 533, the front board is in contact with the cover conveying guide 527 and the spine assumes the V shape as mounted on the cover resist roller pair 535, as indicated with a solid line in FIG. 9.

The cover C, which is retained roughly in the shape of the letter V, has the upper side opened toward the paper conveying unit 54. Thus, the cover C assumes a form capable of easily receiving the paper/sheaf, which is conveyed from the upper position by the paper conveying unit 54. As a result, the paper/sheaf can be readily and infallibly inserted into and nipped in the cover. Further, the cover C, which has been once fed into the paper insertion unit 53, is prevented from going backward because of the repulsive force of its own based on the existence of the depressed area 527*a*. The cover C, therefore, is infallibly retained at all times in an opened state fit for accepting the paper/sheaf. And the paper/sheaf can be readily and infallibly inserted and nipped in the cover C.

The commercially available hot-melt binding covers are known in various types as already stated. In the case of the covers of the type having both front board and back board made of the same material (transparent sheet or cardboard paper) and allowing no discrimination between the front board and the back board, the direction of the cover which has been set in the paper insertion unit 53 poses no problem. In the case of the covers of the type having the front board of a transparent sheet and the back board of an opaque cardboard paper, if the cover C is set in a wrong direction, the cover C will be bound with the front board and the back board mistaken for each other, and the cover C and the papers will be possibly wasted. In the first embodiment which is illustrated, the cover C must be set in the paper insertion unit 53 in such a direction that the back board made of paper comes in contact with the guide plate 533.

Accordingly, the present embodiment is provided with a cover orientation sensor 539 which is disposed in the cover retaining space formed between the guide plates 533 and 532 for discerning the kind of the one of the back board and the front board of the cover C which has reached the cover retaining space. When the cover of the type having the front board of a transparent plastic sheet and the back board of an opaque cardboard of paper is set in a correct direction, the back board of paper is located in the cover retaining space, in which the cover orientation sensor 539 is disposed. The cover orientation sensor 539 is formed of a transmission type photosensor. The cover orientation sensor 539 passes light and assume an ON state when the target is transparent sheet such as an OHP sheet, and intercepts light and assume an OFF state when the target is a sheet such as of paper.

After the elapse of a desired time following the detection of the leading end of the cover C by the cover sensor 525, namely after the leading end of the cover C in the conveying direction safely reaches the cover retaining space, it is judged whether or not the cover C is set in a correct direction in the paper insertion unit 53, based on the status of the cover orientation sensor 539.

Specifically, when the cover C is set in the paper insertion unit 53 and the cover orientation sensor 539 outputs a detection signal indicating an OFF state (no transmission of light), it is judged that the back board made of paper has reached the cover retaining space and the cover C has been set in a normal direction in the paper insertion unit 53, and the processing is continued based on this judgment. In contrast, when the cover orientation sensor 539 outputs a detection signal indicating an OFF state (transmission of light), it is judged that the transparent front board has reached the cover retaining space and the cover C has been set in a wrong direction in the paper insertion unit 53. The case indicates that the user has placed the cover C in the cover storage unit 51, with the front board and the back board of the cover C mistaken for each other. Thus, the binding operation in process is stopped and, at the same time, a suitable alarming operation such as informing the user of the wrong direction of the cover C by means of a display. As a result, the incorrect binding will be precluded and the possibility of the cover C and the papers being wasted will be avoided. If the cover C is set in a wrong direction, the cover C and the sheaf will be discharged in an unbound state into the discharging unit 56.

The paper/sheaf in the cover C is inserted after the cover resist roller pair 535 of the regulating device 502 has moved to the closed position and assumed the state of regulating the lower end position of the cover spine. After the insertion of the papers, the cover resist roller pair 535 is rotated and moved to the opened position and the cover C with the inserted papers is fed to the heating unit 55. As described above, the cover resist roller pair 535 provided in the regulating device 502 fulfills the resist function of regulating the lower end of the cover spine in combination with the function of conveying the cover C holding the inserted paper/sheaf to the heating unit 55. Further, the cover C retained in the paper insertion unit 53 must be thermally insulated from the heating unit 55 for preventing the adhesive layer of the cover from melting until the paper/sheaf is inserted into the cover C. The thermal insulation of this sort is accomplished by the cover resist roller pair 535, which is freely movable.

Figure 10A:
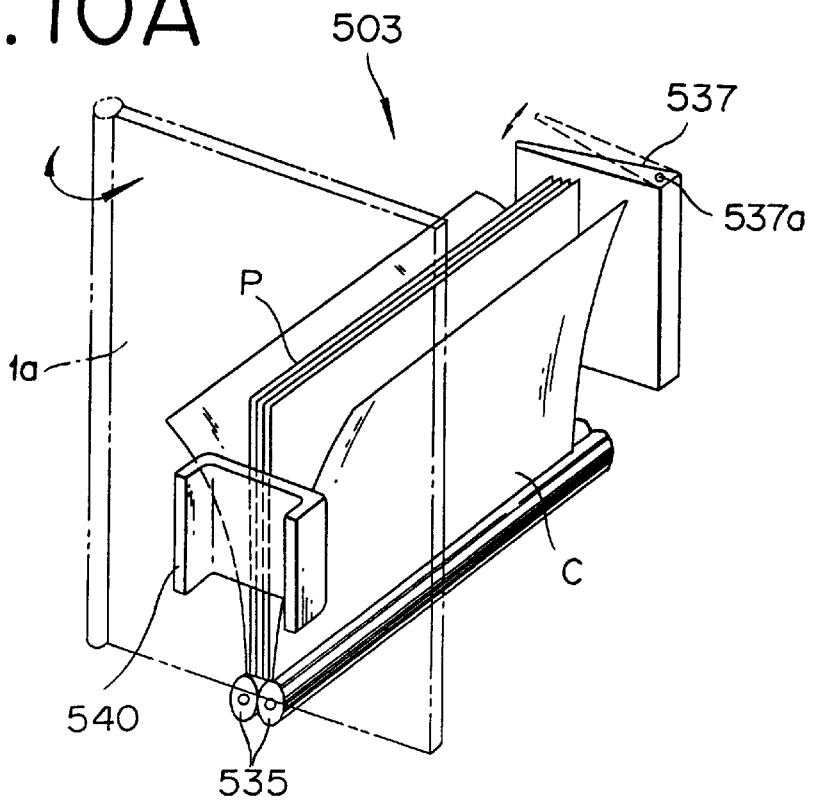
FIG. 10A and FIG. 10B are respectively a perspective view and a top view illustrating a lateral aligning mechanism provided for the paper insertion unit of the binding device.
Figure 10B:
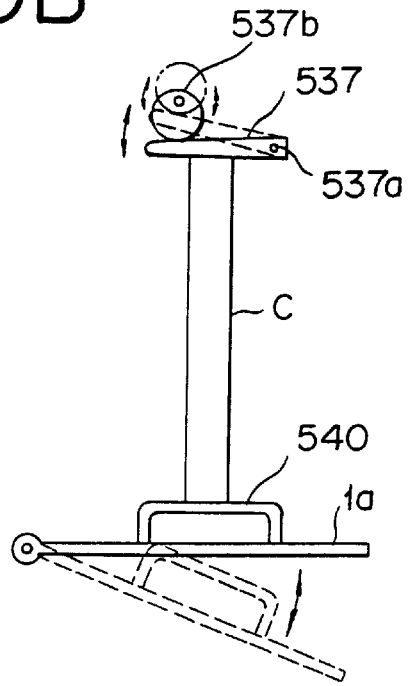

FIG. 10A and FIG. 10B are respectively a perspective view and a top view illustrating a lateral aligning mechanism.

The lateral aligning mechanism 503 is provided with a aligning device 537, which is freely movable in the direction perpendicular to the conveying direction of the cover C, a base plate 540, which is disposed opposite the aligning device 537, and a drive unit 537*b*, which moves the aligning device 537 in the direction perpendicular to the cover conveying direction by rotating the aligning device 537 around a shaft 537*a*.

After the cover has been set in position in the paper insertion unit 53, the drive unit 537*b* drives the aligning device 537 to move in the direction perpendicular to the cover conveying direction and to press one of the lateral end faces of the cover C. As a result, the cover C is moved in the direction perpendicular to the cover conveying direction.

The other lateral end face of the cover C comes in contact with the base plate 540 and its own motion is regulated. It results in regulating the positions of the cover C and the sheaf in the lateral direction. Thus, the "top sides" and the "bottom sides" of the cover C and the sheaf inserted therein are neatly aligned. Incidentally, the cover conveying roller pair 526 are separated from each other during this alignment so as to avoid obstructing the smooth motion of the cover C.

The lateral area of the binding device 5 and the lateral plate of the finisher 1 are opened correspondingly to the position of the paper insertion unit 53. A face cover la is movably disposed in the opening of the lateral plate of the finisher. The base plate 540 is integrally fitted to the face cover 1*a*. Even when the paper insertion unit happens to jam, it is caused simply by opening the face cover 1*a* that the base plate 540 is retreated from the paper insertion unit 53 and an opening is formed opposite the paper insertion unit 53. Thus, the jam can be easily settled. Further, the guide plate 532 is designed so as to be freely opened and closed about a fulcrum as indicated by an alternate long and two short dashes line in FIGS. 7 and 9 for facilitating the disposal of a jam.

The cover resist roller pair 535 is made of a material with small surface friction resistance as compared with other rollers for improving the sliding property of the cover spine during the lateral alignment of the cover. And the cover resist roller pair 535 is formed in a straight shape lest it should avoid taking hold of the end face of the cover and impairing the alignment.

As illustrated in FIG. 9, the position of the leading end stopper 536 is automatically adjusted in accordance with the size of the cover C for use. A antistatic brush 530, which produces a sliding contact with the cover C being conveyed to the paper insertion unit 53, is disposed in the proximity of the downstream of the cover conveying roller pair 526. The antistatic brush 530 eliminates charge from the surface of the cover C being conveyed toward the paper insertion unit 53. Thus, the papers being inserted into the cover C can be prevented from being incorrectly inserted owing to the static adsorption.

[4] Paper Conveying Unit 54

Figure 11:
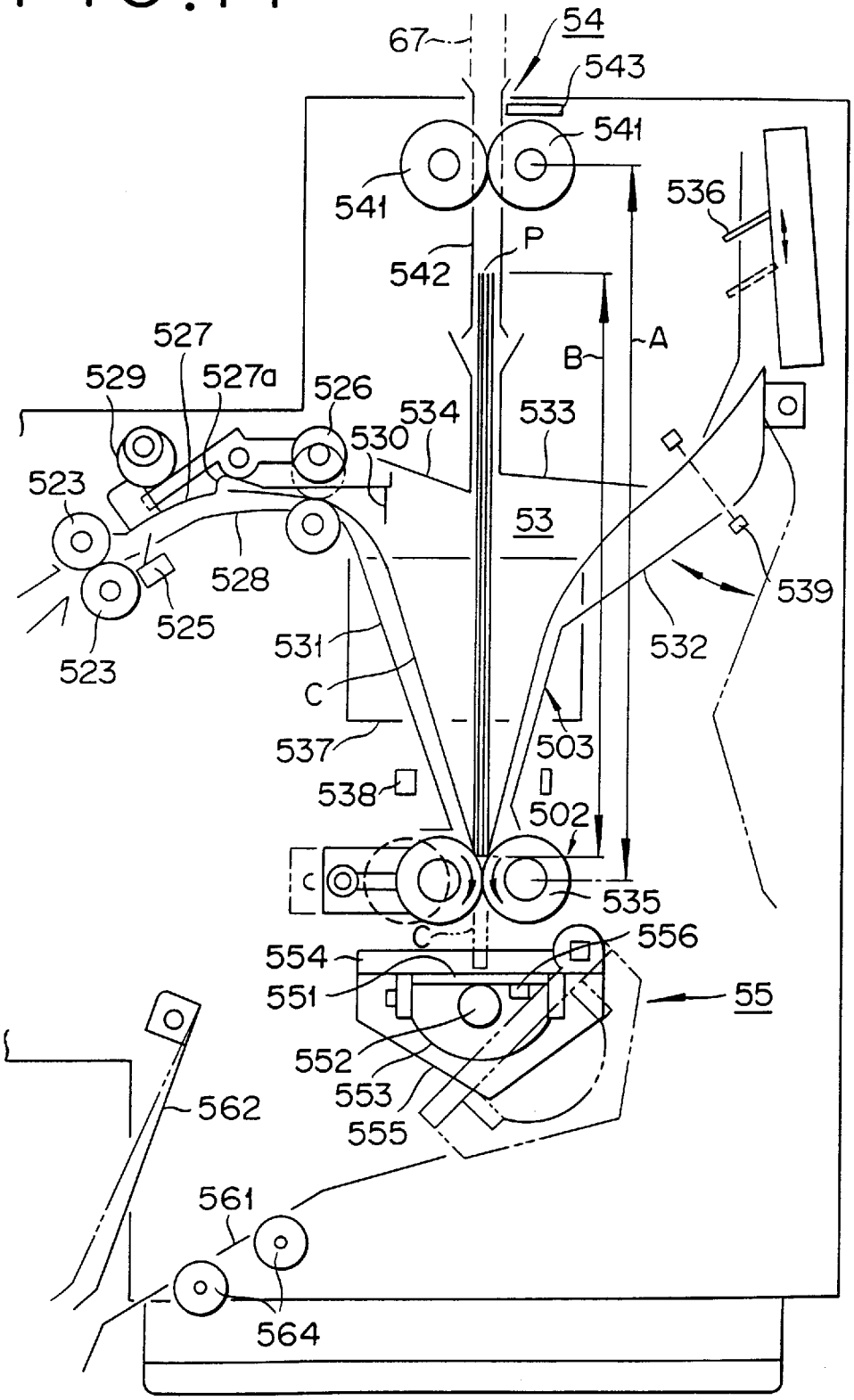
FIG. 11 is an explanatory diagram illustrating the paper insertion unit of the binding device with a sheaf of papers.

The paper conveying unit 54, as illustrated in FIG. 7 and FIG. 11, is provided with a conveying guide pair 542, which are positioned directly above the resist roller pair 535 and connect the conveying route 67 to the paper insertion unit 53, a conveying roller pair 541, which are disposed en route to the conveying guide pair 542 and convey the paper/sheaf to the paper insertion unit 53 on the downstream side, and a paper sensor 543, which detects the paper/sheaf in the conveying guide pair 542.

The paper/sheaf, which has been outputted from the output section 10*b* and conveyed as far as the conveying route 67, is conveyed between the conveying guide pair 542 by the conveying roller pair 541 and then discharged into the cover C, which is in a state opened upward inside the paper insertion unit 53. The conveying roller pair 541 is disposed directly above the cover resist roller pair 535 so that the distance A to the cover resist roller pair 535 is at least longer than the paper/sheaf length B in the direction of conveying (A>B) The paper/sheaf, therefore, drops under the weight of its own and inserted into the cover C. The end of the papers, which is fastened by adhesion, is aligned by this gravity-drop. By the simple arrangement that the paper/sheaf drops under the weight of its own, the sheaf can be aligned along the conveying direction and the lower end of the paper/sheaf can be made to contact infallibly the adhesive layer of the cover. In consequence, the adhesive material infallibly infiltrates into the gaps between the papers when the thermal processing is given to the paper/sheaf at a later stage, and prevents the papers from falling.

When the cover C and the sheaf used in the preceding job still remain in the paper insertion unit 53, the paper/sheaf for the subsequent job is kept waiting in the proximity of the paper insertion unit 53 as nipped by the conveying roller pair 541. Then, after the bound booklet produced in the preceding job has been discharged and the subsequent cover C has been set at position in the paper insertion unit 53, the paper/sheaf kept waiting for the subsequent job is inserted into the cover by gravity-drop.

After the elapse of a desired time following the detection of the passage of the trailing end of the paper/sheaf (the upper end in the diagram) by the paper sensor 543, the lateral aligning device 537 is made to produce a desired number of motions so as to align the paper/sheaf and the cover C in the direction perpendicular to the conveying direction.

[5] Heating Unit 55

The heating unit 55, as illustrated in FIG. 7 and FIG. 11, is composed of a hot plate 551, which heat the spine of the cover C conveyed from the paper insertion unit 53, a heater 552, which is disposed under the hot plate 551 for heating the hot plate 551, a reflecting plate 553, which encircles the lower area of the heater 552 for concentrating the heat of the heater 552 on the hot plate 551, a support plate 554, which integrally supports the hot plate 551, heater 552 and reflecting plate 553, a heat insulating shield 555, which is fixed to the lower surface of the support plate 554, and a temperature sensor 556.

The heater 552 is formed of a halogen lamp or an electric heater and, for energy conservation, is kept at a relatively low temperature while it is kept waiting. When the user inputs the bind mode copying, however, the temperature of the heater 552 is elevated from the stand-by level up to the level proper for heating the cover. The heat insulating shield 555 is formed so as to encircle the heater 552 and the reflecting plate 553 and block the heat of the heater 552. The temperature sensor 556 is formed of a thermistor, for instance, and detects the temperature of the cover heating surface in the hot plate 551.

Figure 12:
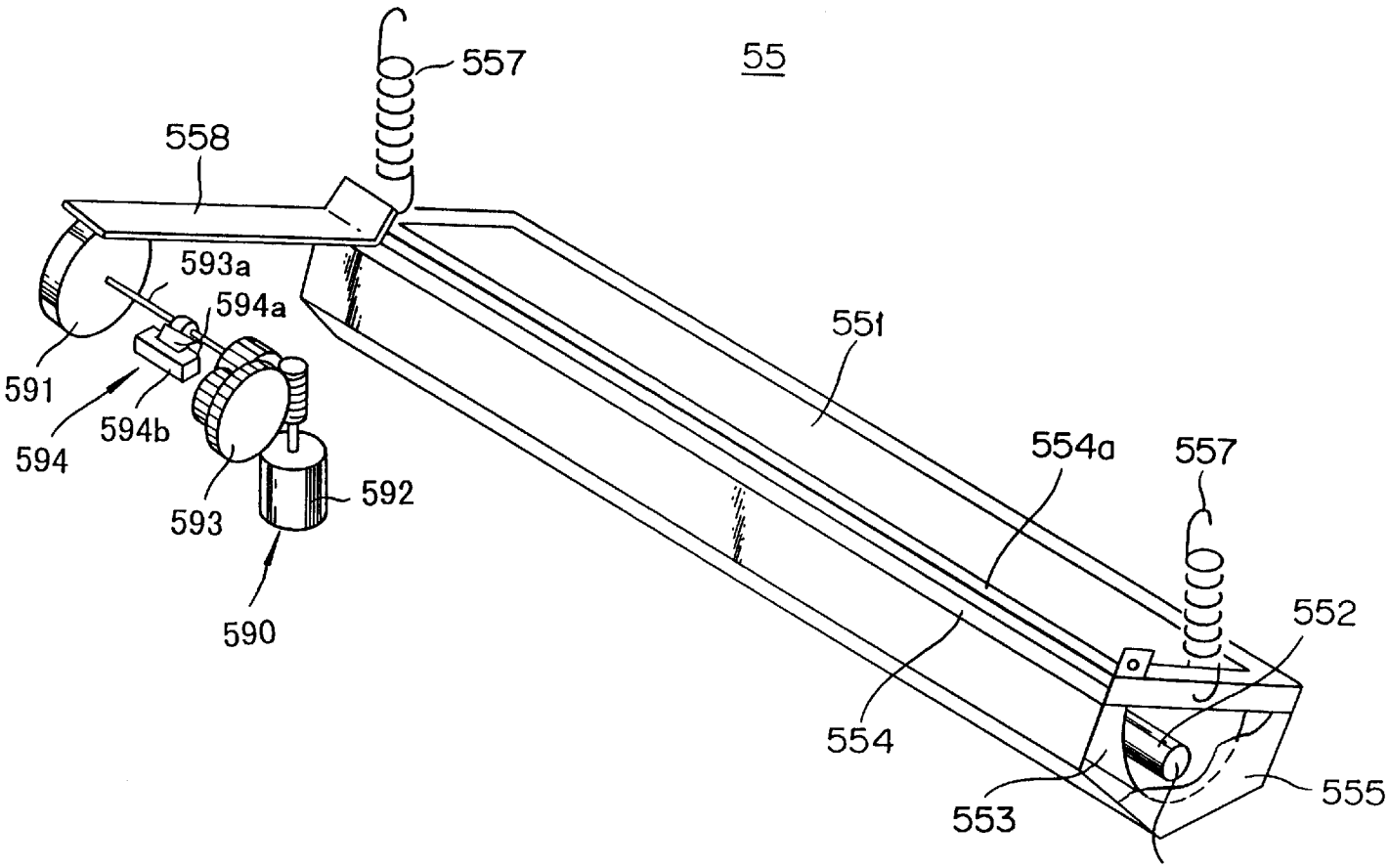
FIG. 12 is a perspective view illustrating a heating unit of the binding device.

The support plate 554, which is so constructed as to be freely revolved around a supporting shaft 554*a* as illustrated in FIG. 12, produces a revolution between the closed position for heating the cover C and the sheaf (the position for enabling the hot plate 551 to assume a horizontal posture)

and the opened position for discharging the bound booklet (the position for enabling the hot plate 551 to assume a posture inclined downward in the direction of the discharging unit 56). Incidentally, return springs 557, which generate a resilient force capable of moving the support plate 554 to the closed position, are disposed at the opposite edges of the support plate 554.

A drive mechanism 590 for driving the support plate 554 is provided with a disk-shaped cam 591, which varies the distance from the center of rotation in consequence of rotation, the motor 592, the gear 593, which transmits the power of the motor 592 to the cam 591 for rotating the cam 591, and the position detector 594, which detects the position of the cam 591.

The position detector 594 is composed of a detection plate 594*a* fixed to a shaft 593*a* of the gear 593 and a photosensor 594*b* for detecting the passage of the detection plate 594*a*. One end of a drive transmitting plate 558 extending parallel to the upper surface of the hot plate 551 is fixed to the rear side of the support plate 554, at which the supporting shaft 554*a* is positioned. The other end of this drive transmitting plate 558 comes in contact with the periphery of the cam 591. When the end of the drive transmitting plate 558 is lifted by the rotation of the cam 591, the support plate 554 is revolved around the supporting shaft 554*a* as the center from the closed position toward the opened position synchronously with the lift. Since the position detector 594 detects the position of the cam 591, the support plate 554 can be stopped at either the closed position or the openeed position.

With reference to FIG. 11, when the sheaf is inserted into the cover C in the paper insertion unit 53, the cover conveying roller pair 526 are pressed to nip the end of the cover C. Thereafter, at least one of the cover resist roller pair 535 (the roller on the left side in the diagram) retreats out of the paper insertion space. Then, the cover resist roller pair 535 is forward rotated (in the direction indicated by an arrow mark in FIG. 11) and, at the same time, the cover conveying roller pair 520 is rotated to feed the cover C and the sheaf to the heating unit 55 in the lower area of the paper insertion unit 53. When the cover spine comes in contact with the upper surface of the hot plate 551 after the elapse of a desired time, both cover conveying roller pair 526 and cover resist roller pair 535 is stopped. At the same time that the cover conveying roller pair 526 are separated from each other, the cover resist roller pair 535 are pressed to nip the cover C and the sheaf.

The alignment of the sheaf inside the cover along the conveying direction is carried out by the following procedure.

Figure 13A:
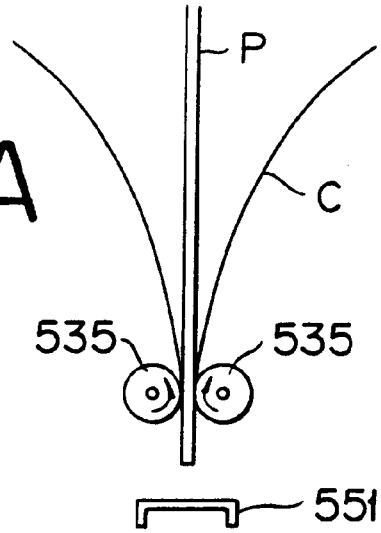
FIG. 13A and FIG. 13B are explanatory diagrams illustrating the procedure of alignment of the sheaf inserted into a cover along the conveying direction.

(1) The cover resist roller pair 535 is reversed in the direction indicated by an arrow mark in the diagram and the cover spine is lifted to the position higher than the hot plate 551, with the cover C and the sheaf on the hot plate 551 nipped by the cover resist roller pair 535 as illustrated in FIG. 13A.

(2) The reversion of the cover resist roller pair 535 is stopped before the cover spine is extracted from the nip area of the cover resist roller pair 535 (the site for nipping the cover C and the sheaf).

Figure 13B:
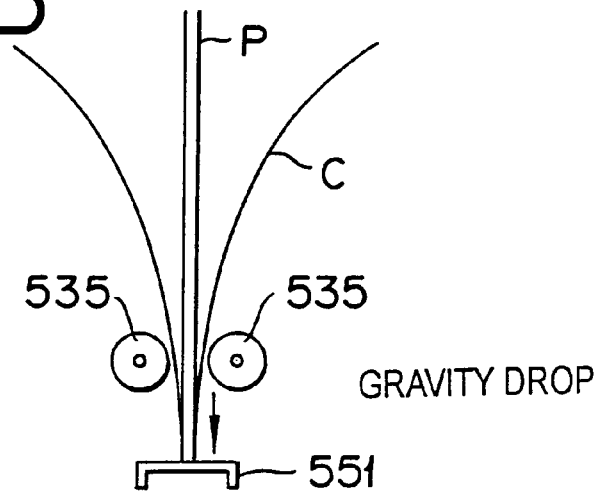

(3) Then, the cover resist roller pair 535 are separated from each other, and the cover C and the sheaf are allowed to fall under their own weights as illustrated in FIG. 13B.

(4) The motions of the items (1)–(3) are repeated up to a desired number of rounds.

By the series of the above operations, the end of the sheaf within the cover C are arranged in order and the alignment of the sheaf within the cover along the conveying direction is completed.

After the operation of alignment has been completed, the cover spine on the hot plate 551 is heated at a proper temperature for a desired time to melt the adhesive material fixed to the cover spine and paste the cover C and the sheaf together, with the cover resist roller pair 535 pressed to nip the cover C and the sheaf.

Figure 14A:
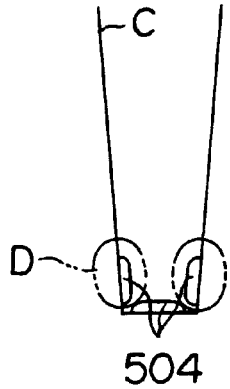
FIG. 14A and FIG. 14B are cross sections illustrating a cover with a adhesive layer formed on the inner face of the spine and FIG. 14C is a cross section illustrating an example of a depressed area formed in a heating plate of the heating unit in the binding device.
Figure 14B:
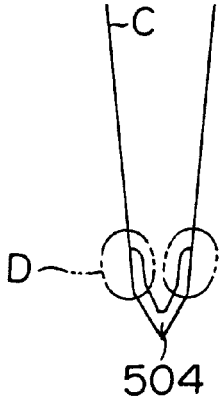
Figure 14C:
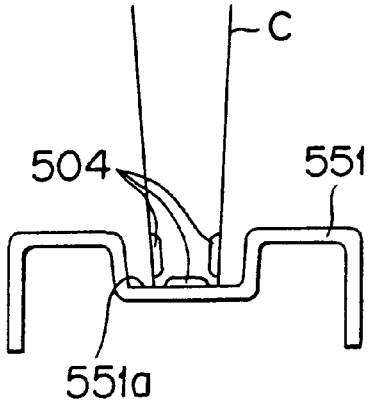

A cover C has an adhesive layer provided on the inner surface of the spine. In particular, the covers C, which has a flat area in the spine, has an adhesive material 504 fixed in a substantially depressed shape extending from the flat area through the front board and the back board (FIG. 14A) In contrast, the covers C, which has no flat area in the spine, has the adhesive material 504 fixed in a substantially U shape (FIG. 14B). When the heating unit for melting the adhesive material 504 fixed in such a shape has a planar shape, the adhesive material 504, which extends from the front board through the back board of the cover C and is located in an area D enclosed with an imaginary line in the diagram, exhibits poor melting property during the course of heating. As a result, the covers C are liable to induce inferior adhesion to the sheaf. As illustrated in FIG. 14C, however, a depressed area 551*a*, which encloses the adhesive material 504 fixed to the cover C, is provided in the area of the hot plate 551 with which the cover spine comes in contact. In short, the melting property of the adhesive material 504 is improved and the inferior adhesion to the sheaf is precluded by transmitting ample heat to the area D.

Figure 15A:
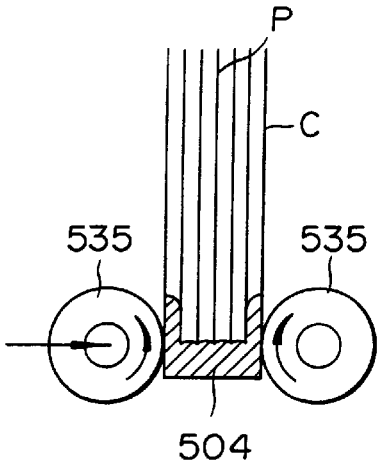
FIG. 15A and FIG. 15B are respectively explanatory diagrams illustrating the arrangement for securely pasting the sheaf to the cover.
Figure 15B:
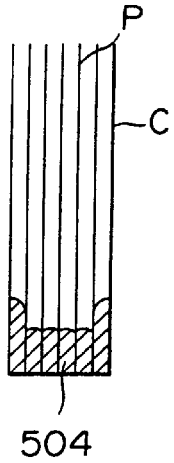

The adhesive material 504 manifests relatively low fluidity while in a melted state. Thus, it is not easily spread thoroughly in the gaps between the adjacent papers P as illustrated in FIG. 15A. When the bound booklet having undergone the thermal processing is discharged in its unmodified form, the pasted area is liable to separate off. Immediately after this thermal processing, therefore, the cover resist roller pair 535 is reversed to press the vicinity of the adhesive layer of the cover. As a result of this pressure, the adhesive material 504 is thoroughly spread between the adjacent papers and to the corners of the edges of papers as shown in FIG. 15B. And the sheaf can be securely pasted to the cover C. In the first embodiment, the cover resist roller pair 535 has the function as a pressing device, which presses the vicinity of the cover adhesive layer which has undergone the thermal processing. That is to say, the cover resist roller pair 535 have three functions, the resist function of regulating the lower end position of the cover spine, the function of conveying the cover C to the heating unit 55, and the function of pressing the vicinity of the adhesive layer of the cover. Since a special device for pressing function is not required, the adherability of the papers can be stabilized inexpensively without entailing an addition to the size of the finisher.

Incidentally, the forward and backward revolution of the cover resist roller pair 535 may be repeated up to a plurality of rounds during the pressurization of the vicinity of the cover spine. Thereafter, the cover resist roller pair 535 is forward revolved and shifted to the discharging operation.

With reference to FIG. 11, the discharging operation of the bound booklet subsequent to the thermal processing is carried out in the following procedure.

(1) The drive mechanism 590 causes the support plate 554 to revolve and retreat from the closed position which is the position for the thermal processing (the horizontal position indicated by a solid line in FIG. 11).

(2) The cover resist roller pair 535 is forward revolved to convey the bound booklet toward the discharging unit 56 on the downstream side.

(3) The cover resist roller pair 535 is stopped after the elapse of a desired time following the detection of the passage of the cover trailing end by the cover sensor 538 of the paper insertion unit 53, namely after the cover trailing end has passed the nip area of the cover resist roller pair 535.

The discharge of the bound booklet is completed by the series of operations.

During this discharging operation, when the hot plate 551 for heating the cover adhesive layer is opened, the bound booklet is guided by the hot plate 551 and discharged toward the discharging unit 56. Namely, the freely rotatable hot plate 551 functions as a guide during the discharge of the cover C toward the discharging unit 56. Thus, the discharging operation can be smoothly carried out.

Incidentally, when the circumstance does not allow detection of the temperature rise of the heating plate (such as when the heater 552 incurs a mechanical trouble or when the temperature sensor 556 incurs a mechanical trouble or a defective circuit contact), the paper/sheaf is inserted into the cover C at the paper insertion unit 53 and then the cover C and the sheaf are discharged into the discharging unit 56 without undergoing the thermal processing.

[6] Discharging Unit 56

As illustrated in FIG. 7, the discharging unit 56 is provided with a discharging guide 561, a blocking plate 562 for regulating the outlet, which is provided in the edge of the discharging guide 561, and a discharge tray 563 for receiving and holding the discharged bound booklet. The discharging unit 56 discharges the bound booklet in such a manner that the cover adhesive layer assumes a lower position relative to the opening side of the bound booklet, and then conveys the discharged booklet and put it to storage.

Specifically, the discharging guide 561 is disposed as inclined downward along the conveying direction of the bound booklet. The bound booklet, which has been conveyed by the heating unit 55, is conveyed toward the outlet along the discharging guide 561. When the trailing end of the bound booklet passes the cover resist roller pair 535, the bound booklet slips down the surface of the discharging guide 561 under its own weight and rests in the discharge tray 563. A plurality of rollers 564 are disposed on the surface of the discharging guide 561 so as to reduce the friction resistance generated between the discharging guide 561 and the bound booklet.

The blocking plate 562, which is so designed as to be freely revolved within a desired area around a fulcrum, regulates the opening size of the outlet and prevent the user from directly touching the heating unit 55.

The discharge tray 563, which is disposed as inclined downward along the conveying direction of the bound booklet, receives the discharged bound booklet in such a manner that the cover adhesive layer falls on the lower position than the opening side of the booklet.

As described above, the bound booklet is discharged, conveyed and stored in such a manner that the cover adhesive layer assumes a lower position relative to the opening side of the bound booklet. Therefore, the papers of the bound booklet can be prevented from falling off accidentally even when the adhesive material, immediately after the thermal processing, has not been thoroughly solidified. Further, the bound booklet can be discharged even before the adhesive material has been thoroughly solidified. It results in reducing the time required for the manufacture of the bound booklet.

Paper Conveyance During Bind Mode

The finisher 1 is possessed of at least two routes, the paper conveying route for use during the "bind mode involving no folding" and the paper conveying route for use during the "bind mode involving folding." The conveyance of the papers P in each of the modes is carried out as follows.

[1] Bind Mode Involving No Folding (1) Bind Mode Without Stapling

The paper outputted from the output section 10*b* is sequentially conveyed into the conveying route 61. Then, the paper is switched back in the switchback section including the switchback conveying route 62, conveyed into the conveying route 63, passed through the conveying route 64, and fed into the paper stacking section 11*b* for storage. When one job full of papers P are stored in the stacking section 11*b*, the resultant sheaf of papers are aligned and passed through the conveying routes 66 and 67, and conveyed into the binding device 5.

The paper stacking section 11*b* is located at a position upstream of the binding device 5. Thus, the papers for use in the next job can be temporarily stacked in the stacking section 11*b* parallel to the binding work even when the sheaf under working is still present in the binding device 5 where a plurality of sheaves are to be bound. When one binding is completed, therefore, the sheaf stacked in the stacking section 11*b* can be conveyed within a short span of time to the binding device 5. It results in shortening the time for storing the papers for the next binding and the waiting time of the coping machine 10 and the finisher 1. In other words, the whole time for the binding can be shortened.

(2) Bind Mode With Stapling

The conveying route 66 is provided with the stapling device 3 for stapling a sheaf of papers held in a stacked state. Therefore, the edge of the sheaf, which has been inserted in the cover C and pasted thereon, can be stapled in at least one place before the sheaf is conveyed to the binding device 5. The stapling of the sheaf is selectable for broadening the width of the user's freedom of choice. When the stapling is selected, the sheaf, which has been conveyed into the conveying route 66, is passed through the conveying route 67 and into the binding device 5 similarly in the preceding case after the edge to be pasted is stapled in at least one place by the stapling device 3. When the stapled sheaf is inserted into the cover C, undergoes the thermal processing and is manufactured into a bound booklet, the papers forming the sheaf are not suffered to slip out of position in process of conveyance and the papers within the cover C are neatly aligned. There is no possibility of the pages of the bound booklet falling off after the thermal processing and the hot-melt binding of the sheaf is stably realized. Further, the sheaf inserted within the cover has been bound with staples. Accordingly, even when the bound booklet, which has been already pasted, encounters the mishap of incomplete adhesion due to some cause or other, there is no possibility of the pages of the bound booklet falling off and the hot-melt binding is stably realized (3) Bind Mode via Conveying Route 65

The papers, which have been outputted from the output section 10*b*, may be conveyed by a switch claw 651 to the conveying route 65, directly fed one by one to the binding device 5 and, after they have totaled a desired number, subjected to the binding. By causing the papers P, which have passed through the conveying route 65, to be conveyed one by one into the binding device 5, the length of the conveying route for conveying the papers P to the binding device 5 is shortened. As a result, the time required for manufacturing a booklet can be shortened and the productivity can be exalted.

[2] Bind Mode Involving Folding

The papers, which have been outputted from the output section 10, are passed through the conveying route 61 and conveyed into the folding device 2 via the switchback conveying route 62. The papers, which have been folded within the folding device 2, are passed through the conveying route 29, conveyed upward, conveyed by the switch claw 651 into the conveying route 65, and directly fed one by one to the binding device 5. After the fed papers have totaled a desired number, the resultant sheaf of papers is subjected to the binding.

In the first embodiment, the sides containing a fold constitute themselves the leading ends in the conveying direction when the folded papers stored in the stacking section 11*b* are conveyed downstream. The folded paper, which has been conveyed from the stacking section 11*b* to the binding device 5, cannot be subjected to the binding. In the first embodiment, therefore, the folded papers are fed through the conveying route 65 one by one to the stacking section 11*b*. When this embodiment is modified so that the folded papers are stored in the stacking section 11*b* with the sides containing a fold reversed, it becomes possible to bundle folded papers and convey the sheaf of papers via the conveying routes 66, 67 to the binding device 5 and subject it therein to the binding.

Without reference to the "presence" or the "absence" of folding, the paper sensor SE1 disposed in the conveying route 61 counts the number of papers P for binding. When the number of papers exceeds the allowable paper binding capacity of the cover C to be used, the paper/sheaf is conveyed into the binding device 5 and the cover C and the sheaf do not undergo thermal processing in the heating unit 55 but are discharged into the discharging unit 56. As a result, the incorrect binding due to an excess of paper supply can be prevented.

If the hot plate 551 of the heating unit 55 has not been heated to an adequate temperature when a command to start copying in the bind mode is inputted, the binding is temporarily suspended with the papers stored in the stacking section 11*b* until the warm-up of the temperature of the hot plate 551 is completed. It prevents the inferior adhesion of the sheaf to the cover C, which occurs when the hot plate 551 is lower than the suitable temperature.

In the case of the mode of passing the papers through the conveying route 65 and conveying them one by one into the binding device 5, the occurrence of a jam is precluded by adjusting the stand-by time of the copying machine proper.

While the cover C and the sheaf are undergoing the thermal processing within the binding device 5, the copying operation in such a mode except the bind mode as a mode of discharging the papers into the non-sort tray 11*a* or a mode of stapling, can be executed. It enables the time, during which the copying operation is not allowed, to be shortened. During a multi-job, the stand-by time is only adjusted on the bind mode.

In the first embodiment, the sort mode using the cover C can be performed. Specifically, the sheaf is inserted within the cover C, and the sheaf and the cover C are, without the thermal processing, discharged into the discharging unit 56. As a result, the copying operation with sorting using the cover C can be accomplished instead of using the sort tray 41.

Besides, the manual bind mode can be performed. The specific operation of the mode is carried out in the following procedure.

(1) The sheaf of papers arbitrarily prepared by the user is directly inserted into the paper stacking section 11*b*.

(2) The additional work to be adopted is selected. The works include the stapling and the binding. In the present embodiment, the binding is selected.

(3) When the binding is selected, the covers C stored in the cover storage unit 51 are conveyed and set in place in the paper insertion unit 53.

(4) The sheaf of papers in the stacking section 11*b* is inserted into the cover C held in the paper insertion unit 53 and subjected to the thermal processing.

Incidentally, only the non-sort mode is accepted while the manual bind mode is in process.

Construction of Cover Storage Unit 51 in Second Embodiment

Figure 16:
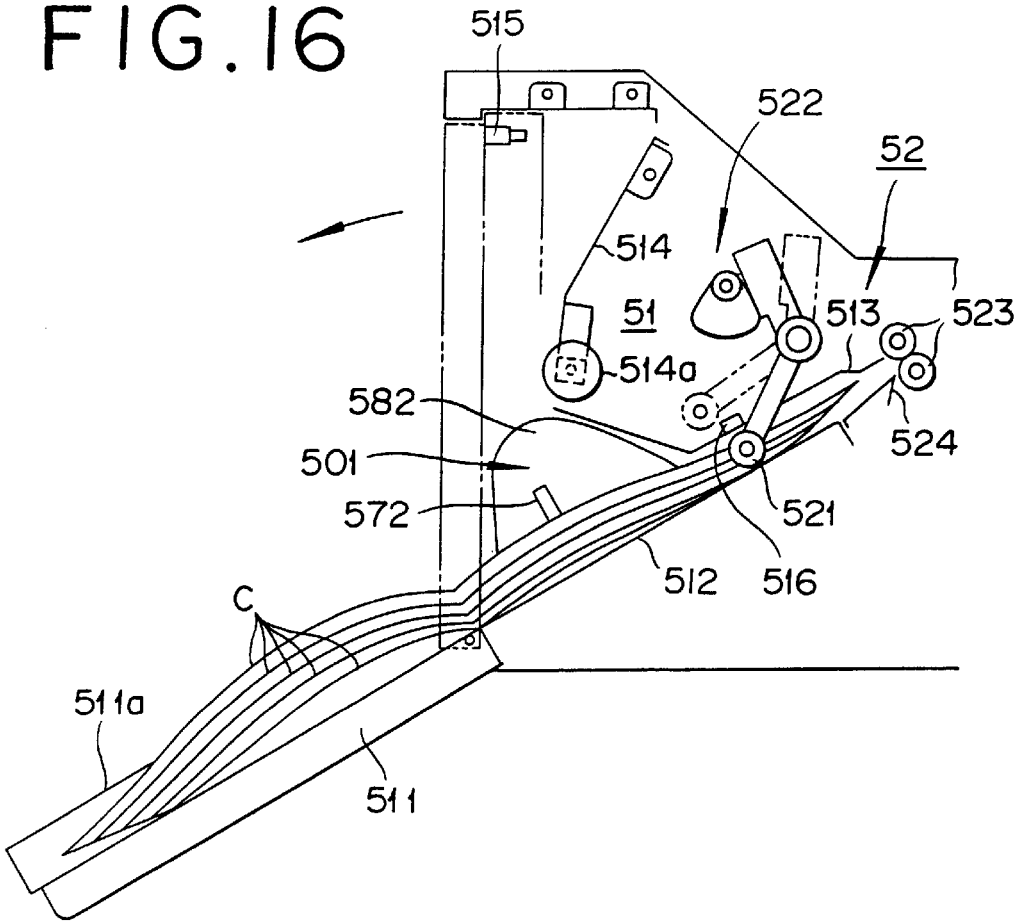
FIG. 16 is a structural diagram illustrating a cover storage unit of the binding device according to the second embodiment.

FIG. 16 is a structural diagram illustrating a cover storage unit of a binding device according to the second embodiment. The second embodiment differs from the first embodiment in respect that the manner of storing the covers C in the cover storage unit 51 is modified.

The cover storage unit 51 of the second embodiment is provided with a holder 511*a* which is substantially shaped like three sides of a square and disposed in the open leading end of the switching door 511 for receiving and retaining the leading end of the front board of the cover C. The switching door 511 is so designed to be retained by a stopper (not shown) in an opened state at a position substantially flush with the surface of the lower guide 512. By keeping the switching door 511 open, the group of covers having the leading ends retained by the holder 511*a* are stacked and retained such that the individual covers are spread at a position allowing the covers to be opened at an angle (the angle formed by the front board and the back board) of about 180°. In the second embodiment, the cover conveying unit 52 is also provided with the pickup roller 521. The pickup roller 521 is so designed as to come in contact with the inner surface of the cover and extract one cover C from the one side of the boards (the back board in the illustrated case).

Incidentally, the area of the cover stuck by the viscous property of the cover adhesive layer is separated by the conveyance of the cover C while keeping the switching door 511 in an opened state. During the cover conveyance, the contact of the uppermost cover C being fed and the adhesive layer of the lower cover, which is adjacent to the uppermost cover C, can be decreased to the smallest possible extent. As a result, the cover C acquires an improved riffling ability and the plurality of covers C superposed by the adhesive layer are separated one by one and securely conveyed.

Incidentally in the second embodiment, the lateral side of the binding device 5 and the side plate of the finisher 1 are opened correspondingly to the position of the cover storage unit 51. The supply of covers C to the cover storage unit 51 is carried out by opening the covers C in a V-shape and inserting the covers C inside through the opening.

In the cover storage unit 51, the covers C are stored as spread and stacked in such a manner that the front board and the back board of the cover form a desired angle. The angle, which is capable of improving the riffling ability of the covers C, does not need to be limited to about 90 degrees shown in the first embodiment or 180 degrees shown in the second embodiment. The desired angle, for instance, may be about 90 degrees which results when the front board and the back board once opened from about 90 degrees to about 180 degrees by opening and closing the switching door 511 are allowed to return.

Construction of Paper Conveying Unit 54 in Third Embodiment

Figure 17:
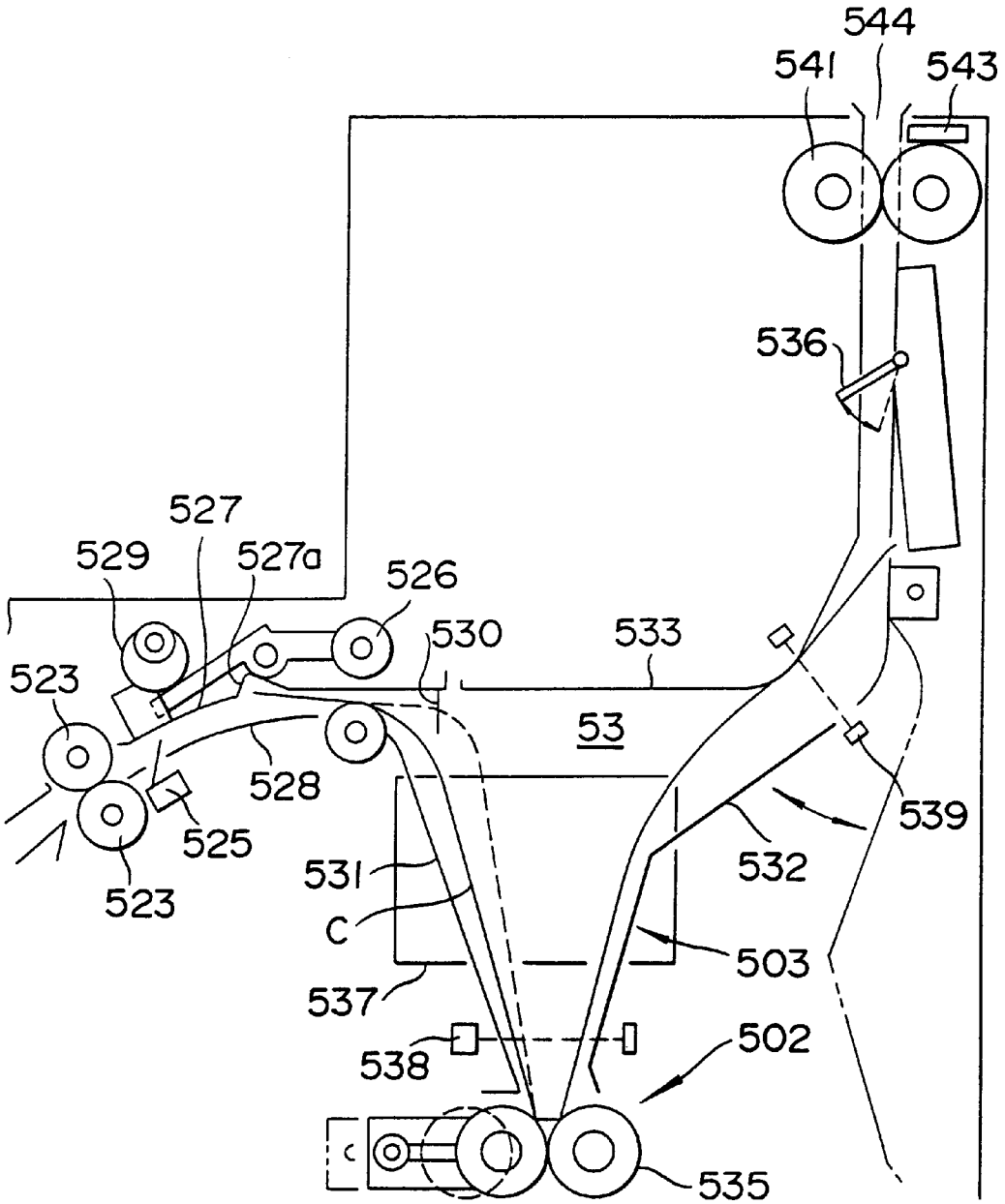
FIG. 17 is a structural diagram illustrating the essential part of the binding device according to the third embodiment.

FIG. 17 is a structural diagram illustrating the essential part of a binding device according to the third embodiment. This embodiment differs from the first embodiment in respect that the construction of the paper conveying unit 54 in the binding device is modified.

The paper conveying unit 54 in the third embodiment is provided with a conveying route 544 which is formed by interconnecting a route, which guides the leading end of the back board toward the leading end stopper 536 disposed in the upper zone of the paper insertion unit 53, and a route, which guides the sheaf advanced through the conveying route 66 or the papers P advanced through the conveying route 65 toward the paper insertion unit 53.

By allowing the routes to be shared, the number of routes is decreased and the simplification of construction is accomplished. The leading end stopper 536 is fixed at such a position as to close the conveying route 544 when the cover C is conveyed and the leading end of the cover presses upward the leading end stopper 536. The leading end stopper 536 retreats out of the conveying route 544 so as to open the conveying route 544 when the paper/sheaf is conveyed to press downward the leading end stopper 536. The motion of the leading end stopper 536 in the manner described above may be attained changing the position of the leading end stopper 536 with a solenoid, for instance, in conformity with the timing for conveying the cover C and the paper/sheaf. Alternatively, it may be effected by additionally providing a spring capable of imparting a resilient force to the leading end stopper 536 in the direction of closing the conveying route 544.

In the third embodiment, the paper/sheaf conveyed by the conveying roller pair 541 is led to the paper insertion unit 53 with the leading end thereof guided by the inner surface of the back board of the cover, allowed to fall under its own weight, and inserted into the cover C.

Fourth Embodiment

Figure 18:
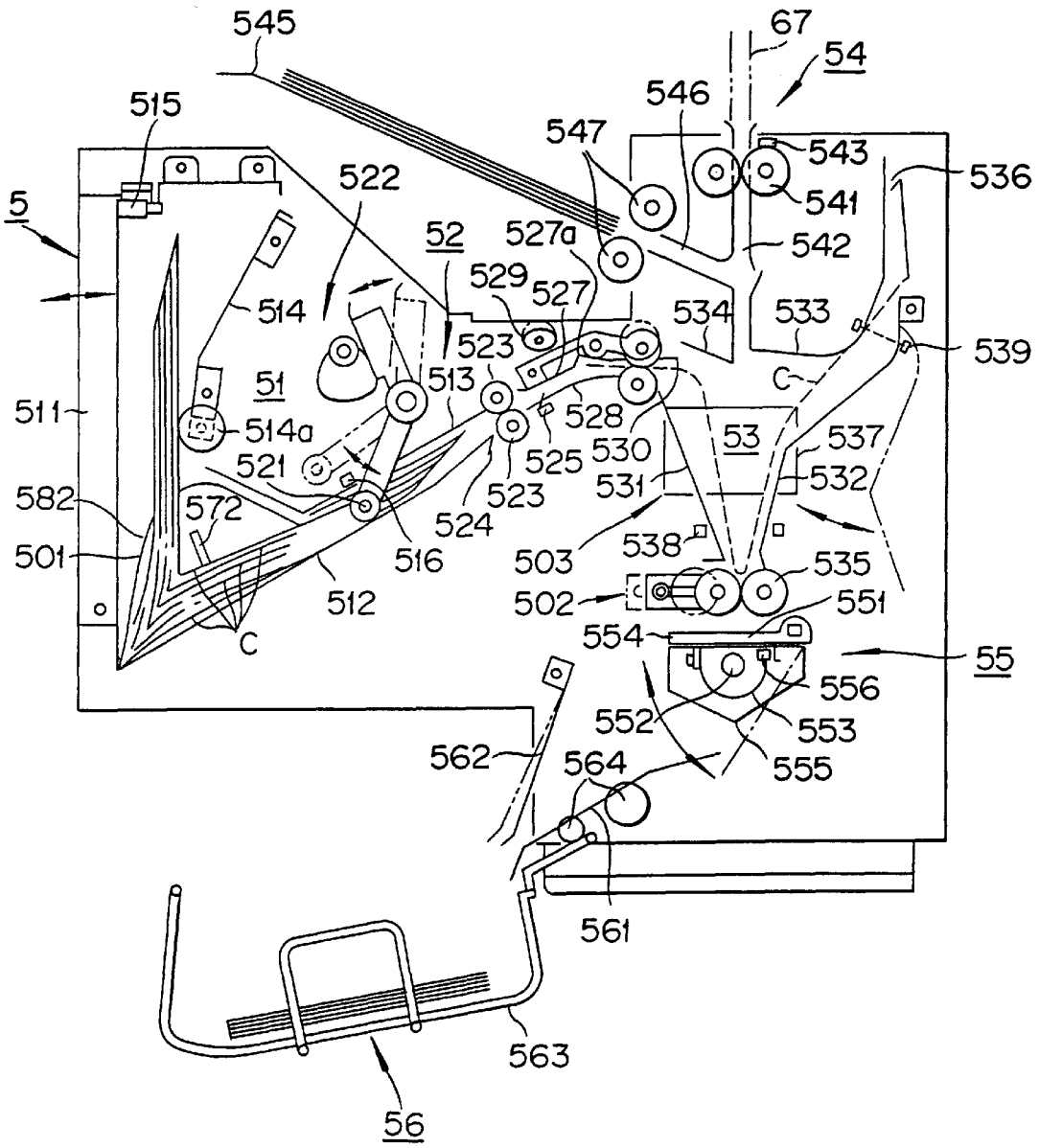
FIG. 18 is a structural diagram illustrating the essential part of the binding device according to the fourth embodiment.

FIG. 18 is a structural diagram illustrating the essential part of a binding device according to the fourth embodiment. This embodiment differs from the first embodiment, which allows execution of the manual bind mode additionally by appropriating the paper stacking section 11*b*, in respect that the fourth embodiment is provided with an exclusive manual binding mechanism.

The binding device in the fourth embodiment is provided with a by-pass feed stand 545, on which a paper/sheaf is manually placed, a by-pass conveying route 546 (equivalent to a third paper conveying route), which connects the by-pass feed stand 545 to the paper conveying guide 542 of the paper conveying unit 54, and conveying roller pair 547, which is freely separable for conveying the sheaf on the by-pass feed stand 545 to the paper insertion unit 53.

According to this arrangement, the papers other than those outputted from the copying machine 10 can be manufactured into a booklet. Thus, the range of utilization of the finisher 1 can be enlarged.

The operation of the manual binding mode is carried out by the following procedure.

(1) The sheaf of papers prepared arbitrarily by the user is set in position on the by-pass feed stand 545.

(2) The covers C stored in the cover storage unit 51 are conveyed and set in position in the paper insertion unit 53.

(3) The conveying roller pair 547 compress the sheaf on the by-pass feed stand 545, conveys the sheaf through the by-pass conveying route 546 and the paper conveying guide 542, and inserts it into the cover C retained in the paper insertion unit 53.

(4) The cover C now holding the sheaf undergoes the thermal processing and is discharged into the discharging unit 56.

The step (2) of the procedure depicted above is not required where the cover C having the sheaf preparatorily inserted therein is mounted on the by-pass feed stand.

When the copying machine 10 or the finisher 1 jams and the thermal processing by the heating unit 55 is forcibly discontinued before completion while the cover C with the sheaf is being heated, the unfinished booklet is immediately discharged into the discharging unit 56.

After the jam has been eliminated, the user again inserts the incomplete booklet through the by-pass feed stand. Thus, the thermal processing can be resumed and the booklet can be completed, with the result that the papers and the cover C otherwise wasted are saved and the otherwise possible rise of the copying cost is reduced.

Fifth Embodiment

This embodiment is characterized by incorporating a control unit, which discharges the papers while omitting the thermal processing of the cover spine, when necessary such as when the thermal processing during the course of bookbinding ought not to be automated.

Further, this embodiment provides outside the finisher with a hand scanner 990 which is connected to the CPU 980 for the finisher. This hand scanner 990 is designed to read a bar code printed on the cover for the identification and inputs the maximum number of papers that can be inserted into the cover (allowable paper binding capacity).

Here, the bar code for the identification of a commodity will be briefly explained.

The bar code, as generally known, is an identification code peculiar to a given commodity attached in recent years to virtually every marketed commodity. The country of production, manufacturer, and individual commodity identification code are expressed by a bar code and a corresponding numeral.

The fifth embodiment uses commercially available covers. Thus, the cover size and the allowable paper binding capacity, which correspond to the bar code, are preparatorily possessed as commodity information. Specifically, the data, which defines the correspondence of such commodity specifications as the cover size and the allowable paper binding capacity, which have been published by the manufacturer, to the bar code is preparatorily stored in the memory. Then, the cover size and the allowable paper binding capacity are set based on the correspondence.

In case of a cover of which the data is not preparatorily stored as commodity information, the cover size and the allowable paper binding capacity are inputted through the control panel OP and stored as commodity information just once at first when the bar code is read by the scanner. In other words, the information about the covers is inputted through the control panel OP just once at first when the covers are varied in types and specification (variations in cover size and width). Then, the cover size and the allowable paper binding capacity can be used by simply inputting the bar code through the scanner.

Incidentally, the present embodiment is provided with a scanner for reading the bar code outside the finisher. The scanner, when necessary, is disposed inside the finisher for automatic reading. Alternatively, the cover size and the allowable paper binding capacity may be outputted through the control panel OP when the covers are stored instead of utilizing the bar code. In this case, the scanner itself may be omitted.

Cover Storage

The operation which is performed in the finisher during the storage of the specific covers C will be described below.

Figure 19:
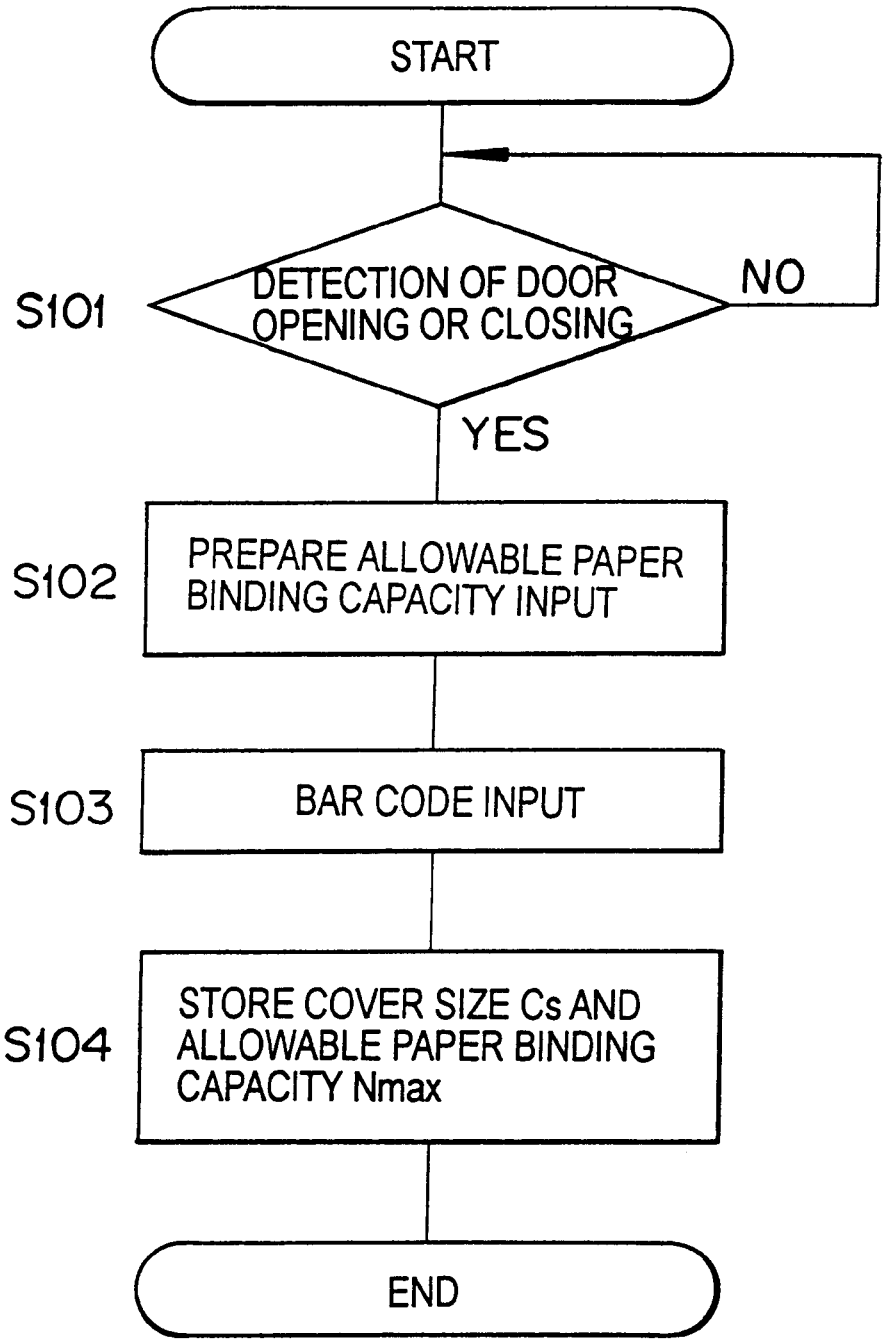
FIG. 19 is a flow chart illustrating the procedure of the operation of the cover storage in the finisher according to the fifth embodiment.

FIG. 19 is a flow chart showing the procedure for the operation during the storage of covers.

First, the open-close sensor 515 detects the operation of opening or closing the switching door 51 for storing covers (S101) The signal outputted from the open-close sensor 515 is transmitted into the CPU 980 of the finisher to start the operation of storing the covers.

Specifically, the CPU 980, in response to a signal as to door opening or closing, inputs a signal of requesting the allowable paper binding capacity of the stored cover, into the CPU 910 of the copying machine, and turns on the hand scanner 990 for preparing to read a bar code (S102).

When the user reads out the bar code on the cover for commodity identification with the aid of the hand scanner, the read data is inputted into the CPU 980 of the finisher (S103).

The CPU 980 searches the correspondence of the input bar code to the preparatorily stored commodity information and stores the size and the allowable paper binding capacity of the received cover in the designated areas in the non-volatile storage 985 (S104). The cover size is stored as Cs and the allowable paper binding capacity as Nmax and are utilized for the binding which will be specifically described herein below.

Binding

Now, the copying operation during the course of bookbinding will be described below.

Figure 20:
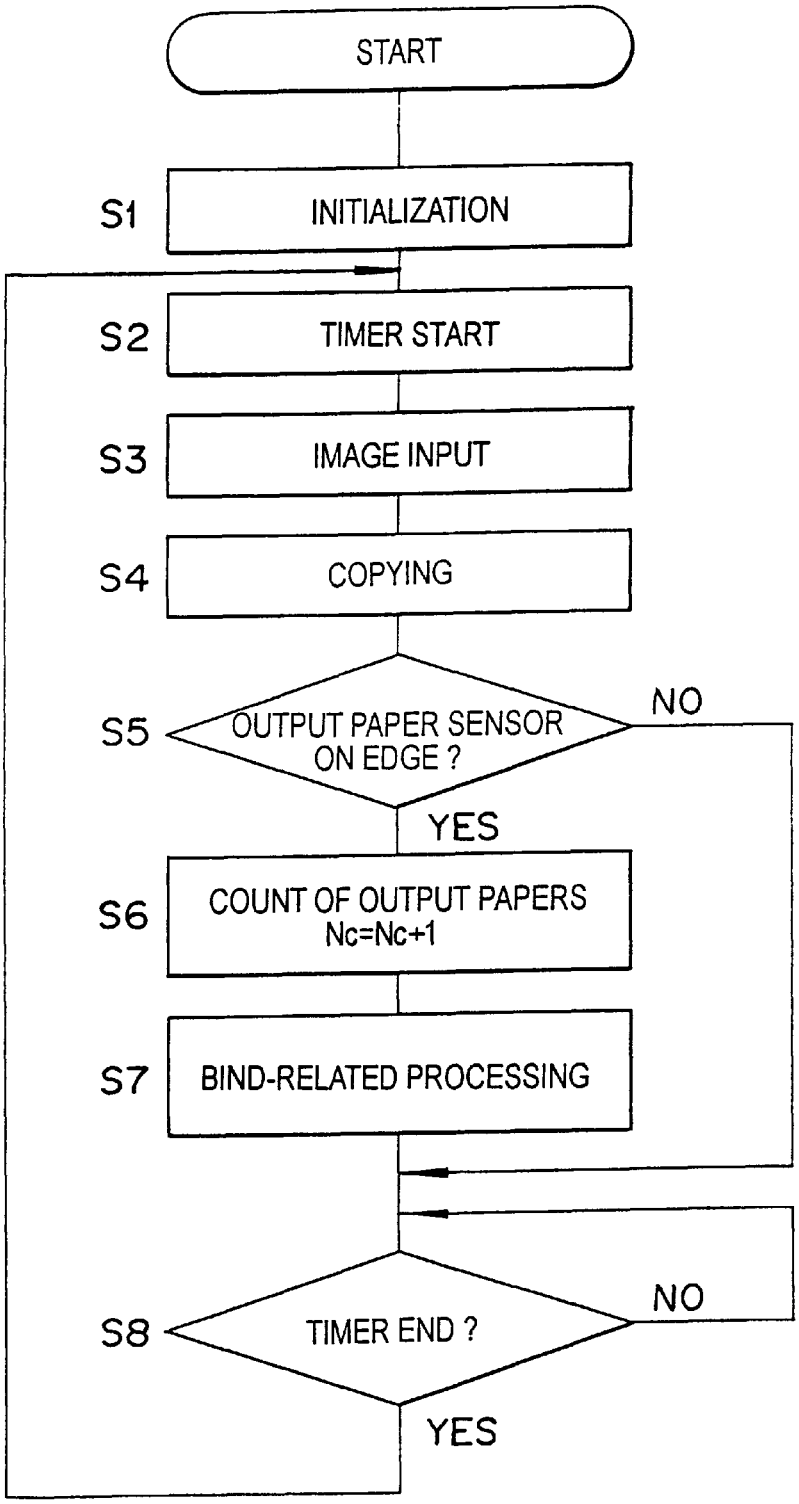
FIG. 20 is a main flow chart illustrating the procedure of the operation of the whole copying process including the binding according to the fifth embodiment.

FIG. 20 is a main flow chart illustrating the whole flow of the copying inclusive of the binding.

First, the copy quantity, the bookbinding, the binding without thermal processing which will be specifically described, etc. are inputted through the control panel OP as initialization (S1). Specifically, when the bookbinding and the binding without thermal processing are inputted, the CPU 910 of the copying machine instructs the CPU 980 of the finisher to effect the operation of bookbinding which will be described below and sets 1 in a bind flag Fb. In response to the instruction, the finisher conveys the covers C from the cover storage unit 51 to the paper insertion unit 53 and sets the covers in position for binding.

Next, the built-in timer of the copying machine is started (S2). The ADF 850 conveys the first of the documents set in position, and the image of the document is read and inputted (S3). Incidentally, the document size Gs is detected by the sensor SE10, which is provided for the ADF 850.

Then, the read image of the document is transferred or reproduced on a paper (S4). When the enlargement or reduction of the image is requested, the relevant image processing is carried out before the copying is started.

The paper with a copied image is outputted from the output section 10*b* of the copying machine 10 and the number of the output papers is counted by the output paper sensor SE20 (S6). When the output paper sensor SE20 has not detected the output of papers, namely when the output signal of the output paper sensor SE20 does not have "ON edge" (S5), the process advances directly to the step S8. This operation is aimed at repeating the operation of image input, for instance, when a given paper, after the formation of the copied image, is not outputted from the copying machine but used again for forming a copied image on the reverse side as in the case of two sided copies.

Incidentally, the papers, which have been outputted from the output section 10*b* of the copying machine, are passed through the conveying routes in the finisher and stored in the paper stacking section 11*b*.

Next, a bind-related processing which will be specifically described is carried out (S7). The completion of the timer's count is awaited (S8). When this completion arrives, the process returns to the step S2 for image input of the next page. Then, the image input(S3), copying(S4), check of the output paper (S5), count of the number of output papers (S6), and bind-related processing (S7) are repeated.

Figure 21:
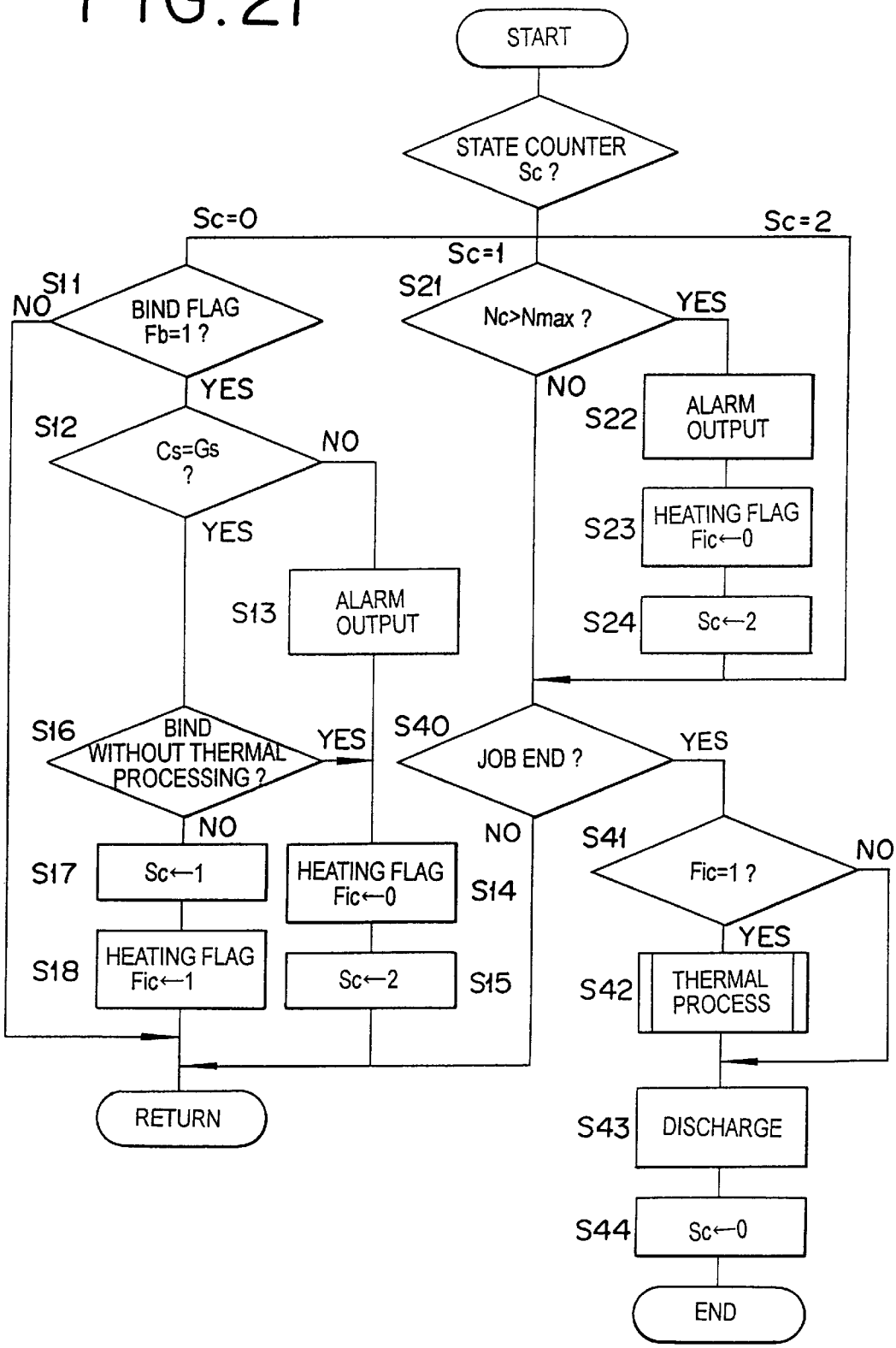
FIG. 21 is a flow chart depicting the bind-related processing of the main flow chart.

Next, the bind-related processing will be described. FIG. 21 is a flow chart illustrating the procedure of the bind-related processing.

First, the state counter Sc is checked (S10). When the state counter Sc is judged to be "0", the process advances to the step S11. In the step S11, it is judged whether the bind flag Fb is "1" or not. In case of "Fb=0", the process skips the bookbinding and immediately returns to the main routine.

In case of "Fb=1" at the step S11, it is judged whether or not the cover size Cs and the document size Gs coincide (S12). When the decision denies coincidence, an alarm message indicating the absence of coincidence is outputted (S13) and the heating flag Fic is set at "0" (S14) and the state counter Sc is set at "2" (S15). As a result, after the completion of the current job, the cover is discharged with merely holding the papers inside and not adhesion.

When the cover size Cs and the document size Gs are judged to coincide at the step S12, it is judged whether or not the mode is for binding without thermal processing (S16). The term "binding without thermal processing" refers to the mode of simply inserting the output papers into the cover without adhesion. In the mode of binding without thermal processing, the heating flag Fic is set at "0" (S14) and the state counter Sc is set at "2" (S15).

When the selection of the ordinary bookbinding (including the work of adhesion) is judged at the step S16, the state counter Sc is set at "1" (S17) and the heating flag Fic is set at "1" (S18)

Incidentally, when the detected value of the state counter Sc is "1" at the step S10, it is judged whether or not the output paper count Nc has exceeded the allowable paper binding capacity Nmax (S21). When the excess is denied, it is judged that the job has been completed (S40). When the job completion is denied, the process returns to the main routine.

When the output paper count Nc has exceeded the allowable paper binding capacity Nmax at the step S21, the alarm message is outputted (S22). Next, the heating flag Fic is set at "0" (S23) and the state counter Sc is set at "2" (S24). The alarm message is for instance, composed of that the total of output papers has exceeded the allowable paper binding capacity and that the papers are discharged without thermal processing (without adhesion). As a result, the cover holding the papers are discharged in an unheated state.

Further, when the detected numeral of the state counter Sc is "2" at the step S10, it is judged whether or not the job has been completed (S40). When the judgment is in the negative, the process returns to the main routine.

When the judgment at the step S40 is in the affirmative, namely when it is detected that all the documents set at the ADF 850 have been used for image input and all the papers carrying a copied image have been discharged, it is judged whether or not the heating flag Fic is "1" (S41). When Fic is "1", namely when the thermal processing is requested, the thermal processing which will be described below is carried out (S42). Subsequently, the discharging procedure is carried out (S43) and the state counter Sc is set at "0" in preparation for the next copying operation (S44) and the whole process is terminated.

When the judgment at the step S41 denies that the heating flag Fic is set at "1", the thermal processing is not carried out but the discharging procedure is carried out (S43). Then, the state counter Sc is set at "0" (S44) and the whole process is terminated.

Figure 22:
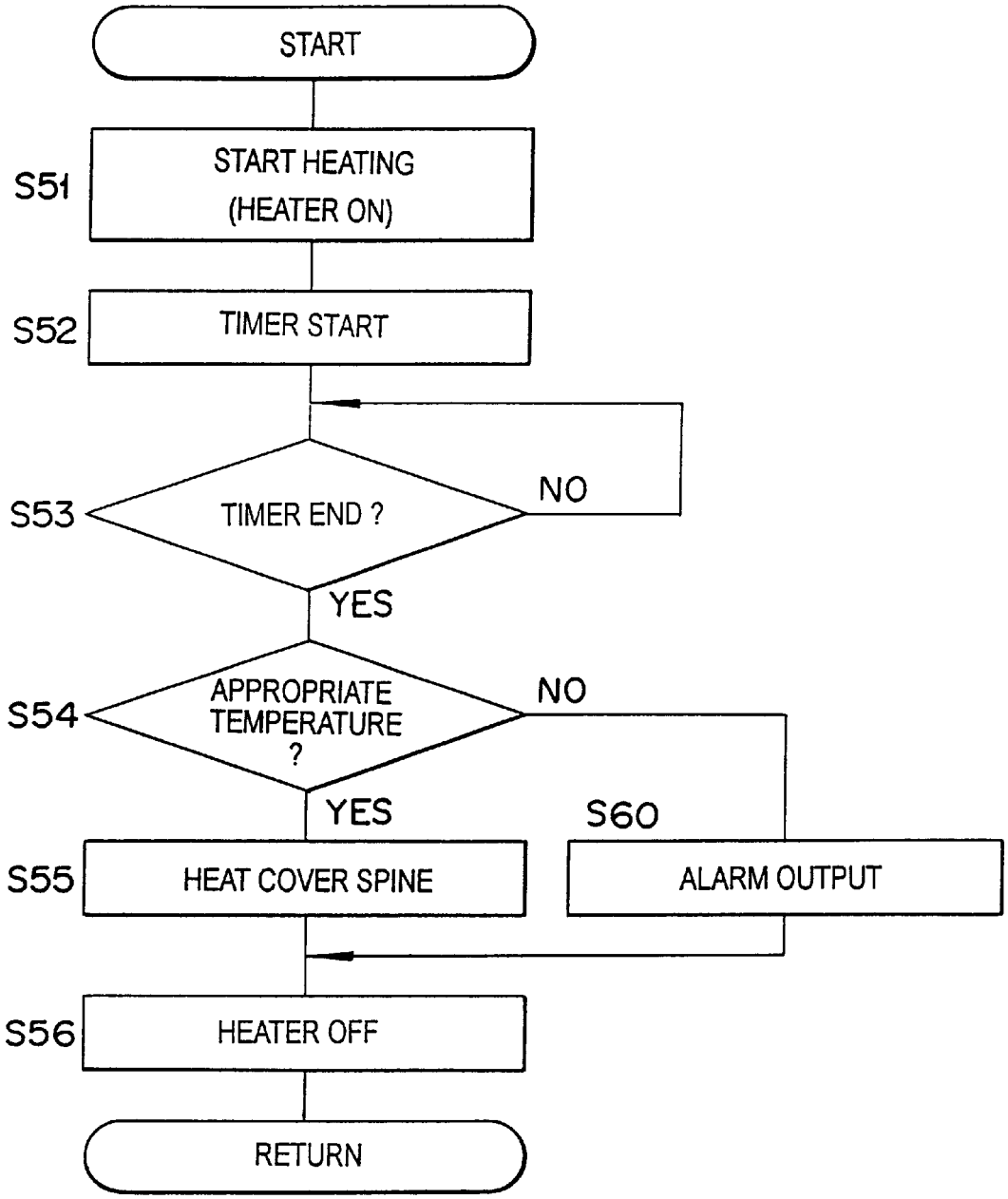
FIG. 22 is a flow chart depicting the thermal processing according to the bind-related processing.

The procedure for the thermal processing will be described below. FIG. 22 is a flow chart illustrating the procedure of the thermal processing.

First, the electric power is supplied to the heater 552 and starts the temperature rise of the hot plate 551 (S51). Then, the timer is started (S52) and the elapse of a desired time is waited for (S53). The waiting time (elapsing time) is about five seconds, which is required for the temperature of the hot plate 551 to reach an appropriate level for melting thoroughly the hot-melt adhesive spread on the cover spine.

Next, it is judged that whether or not the appropriate temperature has been reached based on the signal from the temperature sensor 556 (S54). When the judgment is in the affirmative, the heating of the spine of the bind cover is executed (S55). After the thermal processing has been thoroughly carried out, the supply of electric power to the heater 552 is stopped (S56) and the process returns to the routine for the bind-related processing. Conversely, when the judgment is in the negative, the alarm message that the adhesion is impossible is outputted (S60), the supply of electric power to the heater 552 is stopped (S56), and the process returned to the routine for the bind-related processing. Incidentally, when the appropriate temperature is not reached, a trouble as in the heater or the heating plate, for instance, may be held responsible. In the case of such a trouble as this, the procedures of the steps S52–S54 and S60 will turn out to be a loss of time if the arrival of the temperature at the appropriate level is waited for infinitely. That is to say, these steps are intended for outputting the alarm message and forcibly discharging the cover and the papers inserted inside the cover (with no adhesion).

In consequence of the above procedures, the cover and the papers can be discharged in an unpasted state in response to the automatic judgement during the course of bookbinding such as, when the papers having a copied image have been outputted in a number exceeding the allowable paper binding capacity, when the cover size and the document side do not coincide, or when the thermal processing (the adhesion) cannot be carried out on account of a mechanical trouble. There is, therefore, no possibility that the time to be spent in waiting for the subsequent treatments will be elongated. Further, the inconvenience that the thermal processing is carried through in spite of the absence of appropriate adhesion and the bookbinding will end up in failure, can be precluded. In addition, the mode that the papers are simply inserted into the cover and the adhesion is omitted, can be easily coped with.

Incidentally, the binding of this embodiment, as depicted above, is limited to the procedures relating to the bookbinding. Optionally, however, this embodiment permits the bookbinding to be carried out suitably in combination with the stapling or the folding.

The finisher of this embodiment does not need to be limited to the utility in which it is connected to the copying machine. It may be optionally connected to the image forming apparatus such as a printer or facsimile system.

According to the fifth embodiment, the cover and the papers inserted therein can be discharged without undergoing any further processing. Consequently, the thermal processing may be manually performed by separately setting the heating temperature and time in detail, inserting additional papers into the cover, or extract papers from the papers inserted inside the cover when the thermal processing during the course of bookbinding ought not be automated.

Further, the thermal processing may be discontinued and the cover and the papers inserted therein may be merely discharged when the temperature detected during the course of the thermal processing does not prove to be appropriate. In this case, it is prevented that the cover and the papers incur inferior adhesion due to an insufficient rise of temperature during the thermal processing, and an unduly long waiting time for temperature rise is eliminated. In short, this embodiment enables the finisher to be efficiently utilized.

Furthermore, the cover and the papers inserted therein may be discharged without undergoing a further processing for mutual adhesion when the thermal processing is omitted by means of an input command. As a result, the papers having an image formed on the surface may allow inscription of information or permit insertion of other papers.

It is further permissible to store in advance the allowable paper binding capacity of the relevant cover and, when the total of output papers exceeds the allowable paper binding capacity, omit the thermal processing for the purpose of adhesion. Thus, the cover and the papers which have an image already formed thereon can be utilized again and the possibility of the cover and the papers being wasted can be eliminated.

It is obvious that this invention is not limited to the particular embodiments shown and described above but may be variously changed and modified without departing from the technical concept of this invention.

The entire disclosure of Japanese Patent Applications No. 09-001401 filed on Jan. 8, 1997 and No. 09-004086 filed on Jan. 13, 1997, including the specification, claims, drawings and summary are incorporated herein by reference in its entirety.

What is claimed is:

1. A finisher connected to an image forming apparatus for forming an image on papers such as recording medium, and performing various additional works on papers with an image formed face outputted from the image forming apparatus, the finisher comprising:

a binding device, which produces a bound booklet by inserting papers outputted from the image forming apparatus into a cover with an adhesive layer coated on an inner surface near a spine interconnecting a front board and a back board of the cover, and pasting the cover and the papers, the binding device including a cover storage unit, which stores a plurality of the covers as stacked in a spread state and said cover storage unit is provided with a riffling mechanism which mutually separates the covers stored in said cover storage unit as mutually stuck by the adhesive layer, said riffling mechanism is provided with at least one pair of riffling devices, which have inclined pressing surfaces coming in contact with terminal surfaces of the covers in a direction perpendicular to a conveying direction of the covers and disposed at a position opposite to the covers in a stacked state, and enabled to cause said riffling devices alternately to come in contact with the terminal surfaces of the covers, a cover conveying unit, which extracts one cover from said cover storage unit and conveys the cover, a paper insertion unit, which holds the cover conveyed from said cover conveying unit in an opened state capable of accepting papers, a paper conveying unit, which inserts the papers from the image forming apparatus into the cover held in position in said paper insertion unit, a heating unit, which gives thermal processing to the adhesive layer of the cover with inserted papers, and a discharging unit, which discharges a bound booklet completed by the thermal processing, outside and stores the bound booklet.

2. A finisher connected to an image forming apparatus for forming an image on papers such as recording medium, and performing various additional works on papers with an image formed face outputted from the image forming apparatus, the finisher comprising:

a binding device, which produces a bound booklet by inserting papers outputted from the image forming apparatus into a cover with an adhesive layer coated on an inner surface near a spine interconnecting a front board and a back board of the cover, and pasting the cover and the papers, the binding device including a cover storage unit, which stores a plurality of the covers, a cover conveying unit, which extracts one cover from said cover storage unit and conveys the cover, said cover conveying unit is provided with cover conveying roller pair, which convey the cover in an opened state from an outside of the front board or the back board toward said paper insertion unit, and enabled to be retained in said paper insertion unit in a state opened toward said paper conveying unit by regulating leading end positions of the covers in a conveying direction with a stopper and nipping and conveying the covers by said cover conveying roller pair, a paper insertion unit, which holds the cover conveyed from said cover conveying unit in an opened state capable of accepting papers, a paper conveying unit, which inserts the papers from the image forming apparatus into the cover held in position in said paper insertion unit, a heating unit, which gives thermal processing to the adhesive layer of the cover with inserted papers, and a discharging unit, which discharges a bound booklet completed by the thermal processing, outside and stores the bound booklet.

3. A finisher connected to an image forming apparatus for forming an image on papers such as recording medium, and performing various additional works on papers with an image formed face outputted from the image forming apparatus, the finisher comprising:

a discharging unit, which inserts papers from the image forming apparatus into a cover including a front board and a back board and discharges the cover and the papers, which are merely inserted within the cover without binding; and control means for controlling the discharging unit to discharge the cover and the papers in a state wherein the papers and the cover are not bound together.

4. A finisher according to claim 3, further comprising a cover storage unit, which stores a plurality of covers, and a cover conveying unit, which extracts one cover from said cover storage unit and conveys the cover.

5. A finisher according to claim 3, further comprising a cover holding unit, which holds the cover in a state capable of accepting the papers.

6. A finisher according to claim 3, wherein said cover has an adhesive layer, which is made of a hot-melt adhesive and coated on an inner surface near a spine interconnecting a front board and a back board of the cover.

7. A finisher connected to an image forming apparatus for forming an image on papers such as recording medium, and performing various additional works on papers with an image formed face outputted from the image forming apparatus, the finisher comprising:

a discharging unit, which inserts papers from the image forming apparatus into a cover including a front board and a back board and discharges the cover and the papers, which are merely inserted within the cover without binding;

wherein said cover has an adhesive layer, which is made of a hot-melt adhesive and coated on an inner surface near a spine interconnecting a front board and a back board of the cover; and a heating unit, which gives a thermal processing to the spine of cover with the inserted papers, and a control unit, which alternatively executes a first mode of pasting the cover and the papers by heating the cover spine and discharging the cover and papers in a pasted state or a second mode of discharging the cover and the papers without heating and adhesion.

8. A finisher according to claim 7, further comprising a temperature detector, which detects temperature of said heating unit, wherein said control unit judges whether or not the temperature of said heating unit detected by said temperature detector has reached a level appropriate for melting the adhesive material coated on the inner surface near the spine, and when the judgement is in the negative, discharges the cover with the inserted papers without the thermal processing.

9. A finisher according to claim 7, wherein said control unit does not perform the thermal processing in response to an instruction in advance inputted from the image forming apparatus.

10. A finisher according to claim 7, further comprising a memory unit, which stores an allowable paper binding capacity of the cover stored in a cover storage unit, an input device, which inputs the allowable paper binding capacity into said control unit, and a counting device, which counts papers outputted from the image forming apparatus, wherein said control unit discharges the cover with the inserted papers without the thermal processing when the number of papers counted by said counting device exceeds the allowable paper binding capacity stored in said memory unit.

11. A finisher connected to an image forming apparatus for forming an image on papers such as recording medium, and performing various additional works on papers with an image formed face outputted from the image forming apparatus, the finisher comprising:

a discharging unit, which inserts papers from the image forming apparatus into a cover including a front board and a back board and discharges the cover and the papers, which are merely inserted within the cover without binding; and a bonding unit, which pastes the cover and the papers, and a control unit, which alternatively executes a first mode of pasting the cover and the papers and then discharging the cover and papers in a pasted state or a second mode of discharging the cover and the papers without adhesion.

12. A finisher according to claim 11, further comprising a memory unit, which stores an allowable paper binding capacity of the cover stored in a cover storage unit, an input device, which inputs the allowable paper binding capacity into said control unit, and a counting device, which counts papers outputted from the image forming apparatus, wherein said control unit discharges the cover with the inserted papers without the thermal processing when the number of papers counted by said counting device exceeds the allowable paper binding capacity stored in said memory unit.

13. The method of claim 7, wherein the second mode occurs when the cover is oriented in a wrong direction.

14. The method of claim 7, wherein the second mode occurs when an appropriate temperature for an adhesion process is not detected.

15. The method of claim 7, wherein the second mode occurs when the papers exceed an allowable paper binding capacity of the cover.

16. The method of claim 11, wherein the second mode occurs when the cover is oriented in a wrong direction.

17. The method of claim 11, wherein the second mode occurs when an approximate temperature for an adhesion process is not detected.

18. The method of claim 11, wherein the second mode occurs when the papers exceed an allowable paper binding capacity of the cover.

* * * * *